US010782082B2

(12) United States Patent
Wilkinson et al.

(10) Patent No.: US 10,782,082 B2
(45) Date of Patent: Sep. 22, 2020

(54) BOLT ASSEMBLY FOR BLOWBACK TYPE FIREARMS

(71) Applicant: Sturm, Ruger & Company, Inc., Southport, CT (US)

(72) Inventors: Todd Wilkinson, Goshen, NH (US); Frank J. Saunders, Weare, NH (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 16/161,587

(22) Filed: Oct. 16, 2018

(65) Prior Publication Data

US 2019/0120579 A1 Apr. 25, 2019

Related U.S. Application Data

(60) Provisional application No. 62/574,811, filed on Oct. 20, 2017.

(51) Int. Cl.
*F41A 5/12* (2006.01)
*F41A 3/56* (2006.01)

(52) U.S. Cl.
CPC . *F41A 5/12* (2013.01); *F41A 3/56* (2013.01)

(58) Field of Classification Search
CPC ..... F41C 27/22; F41C 23/06; F41A 5/02
See application file for complete search history.

(56) References Cited

U.S. PATENT DOCUMENTS 1,946,388 A 2/1934 Louis
3,366,011 A 1/1968 Sturtevant
3,491,650 A 1/1970 Rohr
4,088,057 A 5/1978 Nasypany
4,098,016 A 7/1978 Foote
4,476,969 A 10/1984 Dykema
(Continued)

FOREIGN PATENT DOCUMENTS

BG 60727 1/1996
CN 101122453 2/2008
(Continued)

OTHER PUBLICATIONS

International Search Report and Written Opinion for International Application No. PCT/US18/56047 dated Jul. 29, 2019.

*Primary Examiner* — J. Woodrow Eldred
(74) *Attorney, Agent, or Firm* — The Belles Group, P.C.

(57) ABSTRACT

A bolt assembly for firearms utilizing a blowback type operating system. The bolt assembly comprises a non-rotatable bolt slideably disposed in the receiver for forward and rearward movement and a dead blow weight assembly slideably coupled to the bolt. The dead blow weight assembly may be two-piece comprising a dead blow weight and dead blow top member. These parts are separate components movable independently of each other, but functionally interacting and cooperating under recoil after discharging the firearm to eject a spent cartridge casing and chamber a new cartridge as the action is reset. When the firearm discharged, a two-stage felt recoil force is generated by this mechanism, thereby advantageously producing peak forces which are less in magnitude than the single strong felt recoil force experienced by users with conventional one-piece bolt used in many blowback type firearms.

28 Claims, 42 Drawing Sheets

(56) References Cited

U.S. PATENT DOCUMENTS

| | | | |
|---|---|---|---|
| 4,492,050 | A | 1/1985 | Kagehiro |
| 4,677,897 | A | 7/1987 | Barrett |
| 5,726,377 | A | 3/1998 | Harris et al. |
| 5,909,002 | A | 6/1999 | Atchisson |
| 6,761,102 | B2 | 7/2004 | Giza |
| 6,829,974 | B1 | 12/2004 | Gwinn, Jr. |
| 6,848,351 | B1 | 2/2005 | Davies |
| 6,931,978 | B1 | 8/2005 | Dionne |
| 7,055,276 | B2 | 6/2006 | McPherson |
| 7,055,422 | B1 | 6/2006 | Aponte |
| 7,237,469 | B2 | 7/2007 | Murello |
| 7,287,456 | B2 | 10/2007 | Spielberger |
| 7,302,773 | B2 | 12/2007 | Rozhkov et al. |
| 7,467,581 | B2 | 12/2008 | Botty |
| 7,562,614 | B2 | 7/2009 | Polston |
| 8,074,391 | B2 | 12/2011 | Petrůj |
| 8,418,389 | B1 | 4/2013 | Lukman et al. |
| 8,783,158 | B2 | 7/2014 | Kerbrat et al. |
| 8,800,424 | B2 | 8/2014 | Gangl et al. |
| 8,899,141 | B2 | 12/2014 | Reynolds et al. |
| 8,943,726 | B2 | 2/2015 | Kincel |
| 8,973,483 | B2 | 3/2015 | Sullivan |
| 9,038,525 | B2 | 5/2015 | Sullivan et al. |
| 9,228,786 | B2 | 1/2016 | Sullivan et al. |
| 9,448,019 | B2 | 9/2016 | Kokinis et al. |
| 9,513,076 | B2 | 12/2016 | Kolev et al. |
| 2012/0137870 | A1 | 6/2012 | Lindsay et al. |
| 2012/0144713 | A1 | 6/2012 | Dubois |
| 2012/0204713 | A1 | 8/2012 | Patel |
| 2014/0190056 | A1 | 7/2014 | Troy et al. |
| 2014/0224112 | A1 | 8/2014 | Verry |
| 2016/0187082 | A1 | 6/2016 | Pizano |
| 2016/0245601 | A1 | 8/2016 | Kedairy |
| 2017/0045317 | A1 | 2/2017 | Sullivan et al. |
| 2017/0160027 | A1 | 6/2017 | Gangl |
| 2018/0245878 | A1* | 8/2018 | Cornwell ..... F41C 27/22 |

FOREIGN PATENT DOCUMENTS

| | | |
|---|---|---|
| DE | 19524418 | 1/1997 |
| EP | 738864 | 10/1996 |
| FR | 1295559 | 6/1962 |
| GB | 190914223 | 10/1909 |
| GB | 347143 | 4/1931 |
| WO | 200376864 | 9/2003 |

* cited by examiner

BOLT ASSEMBLY FOR BLOWBACK TYPE FIREARMS

CROSS-REFERENCE TO RELATED APPLICATIONS

The present application claims priority to U.S. Provisional Application No. 62/574,811 filed Oct. 20, 2017, which is incorporated herein by reference in its entirety.

BACKGROUND

The present invention generally relates to firearms, and more particularly to a bolt assembly which reduces felt recoil when discharging a firearm.

Some self-loading long guns (e.g. rifles and carbines) with ammunition magazines utilize a blowback type operating system or action. In such firearms, a non-locking and non-rotatable type bolt of one-piece construction is commonly used. Unlike rotating bolts used in manual bolt-action rifles or AR-15/M16 type rifles, blowback bolts form a closed but not a mechanically locked breech because they lack the radial bolt lugs and mating lugs formed in the receiver or barrel necessary to create a locked breech like the foregoing firearms. Instead, bolts used in blowback type operating systems rely on inertia created by the weight of the bolt and a forward spring-force applied to the bolt in order to maintain a closed breech during firing.

Bolts found in blowback type operating systems generally comprise a front breech block and face which abuts the rear of the cartridge chamber formed in the barrel to form the closed breech. After discharging the firearm, the bolt is thrust rearward by considerable recoil forces generated by detonating the gunpowder load in the cartridge. The bolt travels rearward to open the breech and unload the spent cartridge casing, and then is returned forward by a recoil spring to strip a fresh cartridge from the magazine which is chambered by the bolt.

The recoil forces generated by firing a blowback type firearm with one-piece bolt creates a peak recoil force that is felt by the user ("felt recoil"), which may be greater than desired. Accordingly, an improved bolt design is desired which lessens felt recoil.

SUMMARY OF THE INVENTION

Embodiments of the present invention provide an improved bolt assembly for firearms utilizing a blowback type operating system. A multi-piece bolt assembly is provided in one embodiment comprising a bolt slideably disposed in the firearm receiver for forward and rearward movement and a dead blow weight assembly operably coupled to the bolt. The dead blow weight assembly is slideably mounted to the bolt and movable in a linear manner rearward and forward with respect to the bolt under recoil. The present bolt may be both non-rotatable and non-locking in design and operation. A recoil spring acts on the dead blow weight assembly, which in turn biases the bolt forward towards a closed breech position.

In one embodiment, the dead blow weight assembly may be two-piece comprising a dead blow weight and dead blow top member. These parts are separate components movable independently of each other, but functionally are interacting and cooperating under recoil after discharging the firearm to eject a spent cartridge casing and chamber a new cartridge as the action is reset. When the firearm discharged, a two-stage felt recoil force is generated by this mechanism, thereby advantageously producing peak forces which are less in magnitude than the single strong felt recoil force experienced by users with conventional one-piece bolt used in many blowback type firearms.

In one respect, a blowback type firearm with bolt assembly comprises: a longitudinal axis; a receiver defining a longitudinally-extending cavity; a barrel supported by the receiver; a bolt slideably mounted in the receiver for reciprocating movement between a forward closed breech position in battery with the barrel and a rearward open breech position; a dead blow weight assembly slideably mounted to the bolt, the dead blow weight assembly moveable relative to the bolt between a forward position and rearward position; and a return spring acting on the dead blow weight assembly, the return spring biasing the dead blow weight assembly towards the forward position, the dead blow weight assembly in turn acting on and biasing the bolt towards the closed breech position. In one embodiment, the In another respect, a blowback type firearm with bolt assembly comprises: a longitudinal axis; a receiver housing a trigger-actuated firing mechanism and defining an axially elongated cavity; a barrel supported by the receiver; a bolt slideably mounted in the cavity of the receiver for reciprocating movement between a forward closed breech position in battery with the barrel and a rear open breech position; a dead blow weight assembly slideably mounted to the bolt, the dead blow weight assembly moveable relative to the bolt between a forward position and rearward position; the dead blow weight assembly comprising: a dead blow weight slideably mounted in a chamber of the bolt and movable forward and rearwards therein; and an axially elongated dead blow top member slideably positioned on top of the bolt and the dead blow weight, the dead blow top member axially movable forward and rearward relative to both the dead blow weight and bolt; and a return spring acting on the dead blow weight assembly, the return spring biasing the dead blow weight assembly towards the forward position, the dead blow weight assembly in turn acting on and biasing the bolt towards the closed breech position.

In another respect, a blowback type firearm with bolt assembly comprises: a longitudinal axis; a receiver defining an axially elongated cavity; a barrel supported by the receiver; a non-rotatable bolt slideably mounted in the cavity of the receiver for reciprocating movement between a forward closed breech position in battery with the barrel and a rear open breech position; a dead blow weight slideably disposed in an upwardly open chamber of the bolt, the dead blow weight moveable relative to the bolt between a forward position engaging a front surface in the chamber when the bolt is in the closed breech position, and a rearward position engaging a rear surface in the chamber when the bolt is in the open breech position; an axially elongated dead blow top member slideably positioned on top of the bolt and selectively engageable with the dead blow weight, the dead blow top member axially movable forward and rearward relative to both the dead blow weight and bolt; and a return spring acting on the dead blow top member, the return spring biasing the dead blow top member forwards which in turn biases the dead blow weight towards the forward position; the dead blow weight in turn biasing the bolt towards the closed breech position.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. Any references herein to a whole figure number (e.g. FIG. 1) shall be construed to be a reference to all subpart figures in the group (e.g. FIGS. 1A, 1B, etc.) unless otherwise indicated.

DETAILED DESCRIPTION OF EMBODIMENTS

Figure 1:
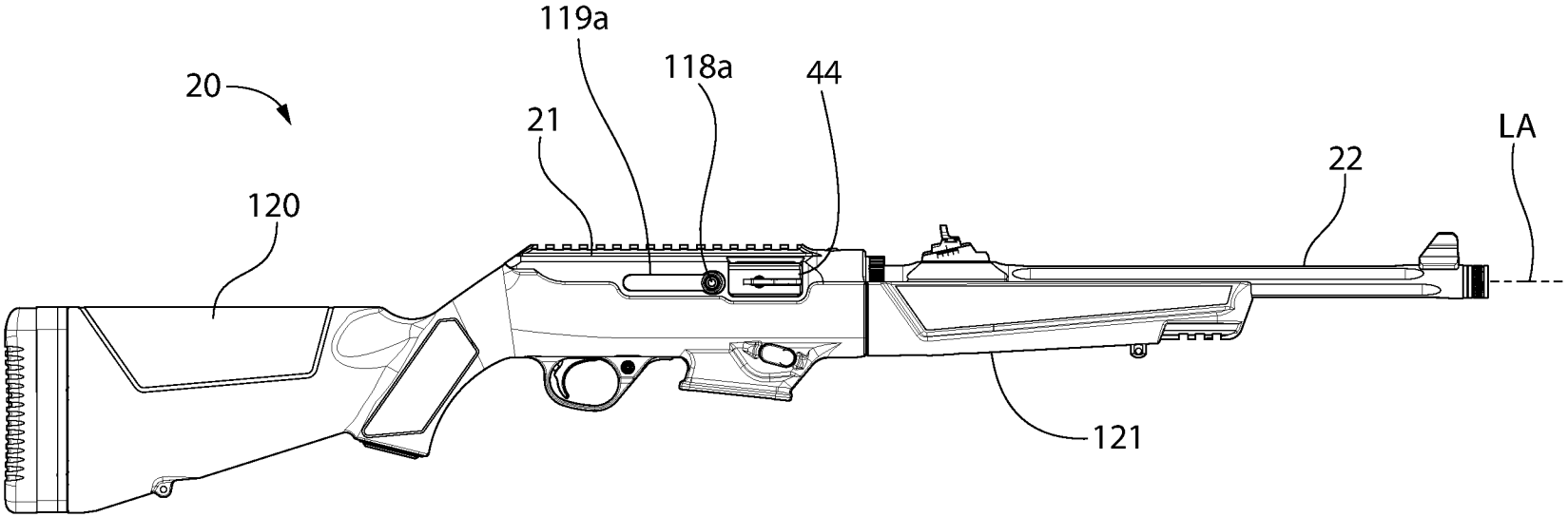
FIGS. 1 and 2 are right and left side views of a firearm with blowback type operating system having a multi-piece bolt assembly according to the present disclosure.

The features and benefits of the invention are illustrated and described herein by reference to preferred but non-limiting exemplary embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-5 depict a firearm 20 including a bolt assembly 50 according to the present disclosure. In one non-limiting embodiment, the firearm as illustrated may be a carbine. However, the firearm could be rifle with longer barrel.

Firearm 20 includes a longitudinal axis LA, receiver 21, barrel 22 coupled thereto, bolt assembly 50, and a trigger-actuated firing mechanism 23 supported by the receiver and including a movable trigger 24 mounted to the receiver. The firearm includes a rear buttstock 120 mounted to the receiver and forearm 121 mounted to the receiver and/or barrel. A downwardly open magazine well 32 is formed by the receiver which holds an ammunition magazine 33 (shown in dashed lines) detachably mounted in the well. Such magazines may hold a spring-biased vertical stack of ammunition cartridges C which are uploaded into the breech area 34 for loading into the rear of barrel 22 by the bolt assembly 50 in a conventional manner when cycling the action. In one embodiment, the cartridge C may be a centerfire cartridge with a centrally located percussion cap disposed in the rear exposed end of the base of the cartridge. This type of cartridge is well known to those skilled in the art without further elaboration. The magazine 33 is removably retained in the magazine well 32 by a pivotable magazine latch 35.

Barrel 22 includes an axial bore 37 extending longitudinally and axially from a rear breech end 38 to a front muzzle end 39 from which a bullet or slug is discharged from the firearm. The centerline of bore 37 is coaxial with and defines the longitudinal axis LA of the firearm. The rear breech end 38 of the barrel 22 defines a rearwardly open diametrically enlarged chamber 36 configured for holding a cartridge C.

Receiver 21 defines an axially elongated internal cavity 40 which slidably carries and supports the bolt assembly 50. Cavity 40 extends along the longitudinal axis LA between the open front end 18 in communication with the barrel chamber 36 for loading cartridges therein and a closed rear end 19 defined by vertical rear end wall 43. Barrel 22 is coupled to the front end 18 of the receiver. In one non-limiting embodiment, the receiver 21 includes a right ejection port 44 and left ejection port 45 formed on opposite lateral sides of the receiver.

The firing mechanism 23 may further include the following components mounted in the receiver 21: a pivotable and cockable hammer 25; pivotable sear 26 which is configured and operable to hold the hammer in a rear cocked position (see, e.g. FIG. 3); a sear disconnector 27 operably engaged with the sear; and disconnector spring 27*a* acting between the disconnector and sear. Hammer 25 is biased forward by hammer spring 31. Pulling the trigger 24 rearward operates to lift disconnector 27 which in turn rotates the sear 26. This disengages a hook or ledge 28 formed on the front of the sear from a downward facing sear notch 29 on the hammer 25, thereby releasing spring-biased hammer 25 forward which strikes the rear end of firing pin 30 slidably carried by the bolt assembly 50. This drives the firing pin forward to strike a chambered cartridge C held in the chamber 36 of the barrel 22 for discharging the firearm 20.

Bolt assembly 50 is axially movable in the internal cavity 40 of the receiver 21 between forward closed breech and rearward open breech positions. A bolt handle 51 is rigidly secured to the bolt 52 of the assembly to manually cycle the action and move the bolt between the forward and rearward positions. Bolt assembly 50 is also automatically moved under recoil between the forward and rearward positions when the action is cycled after discharging the firearm to eject a spent cartridge casing and chamber a new fresh cartridge. Cavity 40 therefore has an axial length to provide the full range of motion necessary for the bolt assembly 50 moving rearward under recoil to open the breech sufficiently for extracting and ejecting a spent cartridge casing, and uploading a new cartridge into the barrel chamber 36 from the magazine 33. In one embodiment, without limitation, the bolt 52 may be part of a "blowback" type action firearm in which the bolt does not lock in place with the barrel chamber by using a rotating bolt or other type of mechanical toggle. Simple blow back designs are generally feasible for cartridges with low pressures, typically for example 0.22 LR, 9 mm, 0.45 ACP, and 0.40 S&W. The main resistance which keeps the breach closed is achieved through the slide mass.

Figure 2:
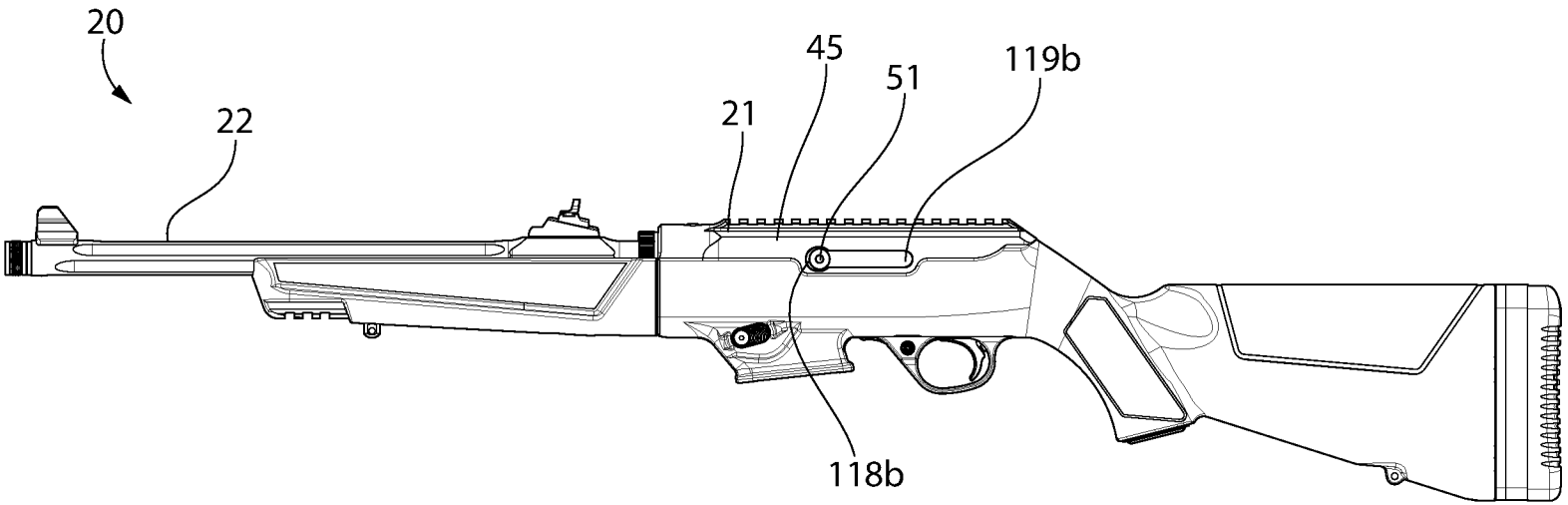
Figure 3:
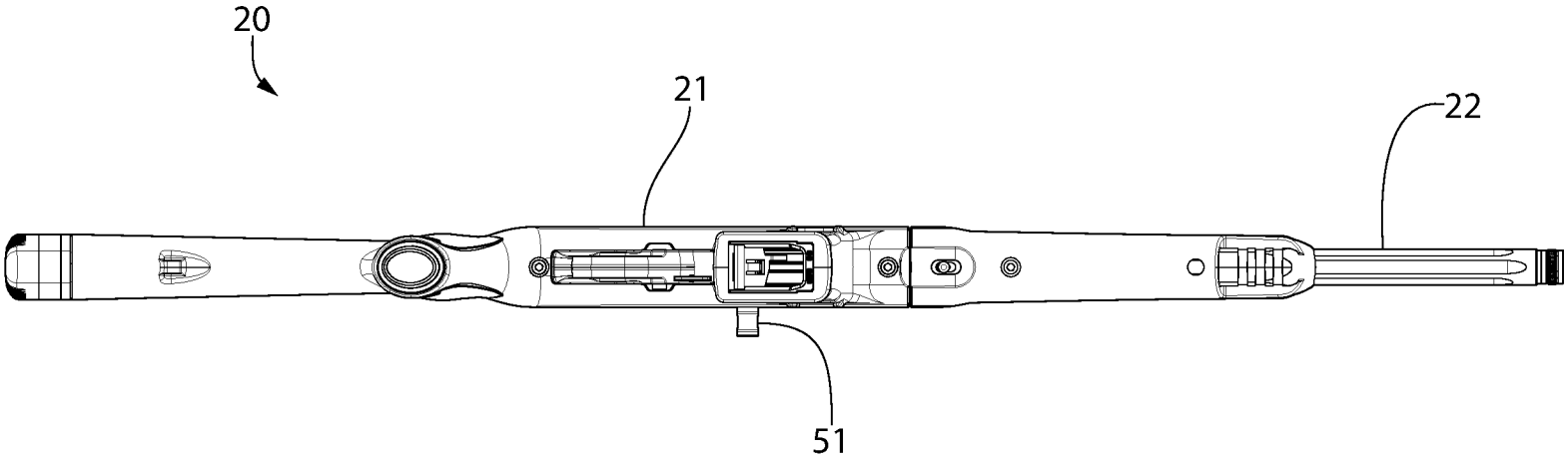
FIG. 3 is a bottom plan view thereof.
Figure 4:
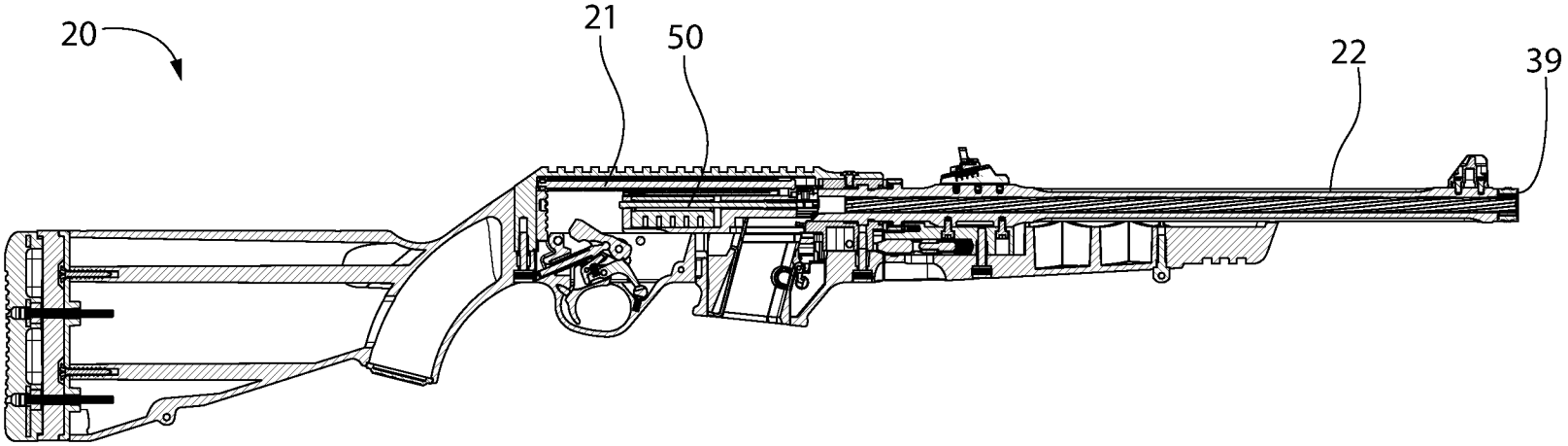
FIG. 4 is a right side longitudinal cross-sectional view thereof.
Figure 6:
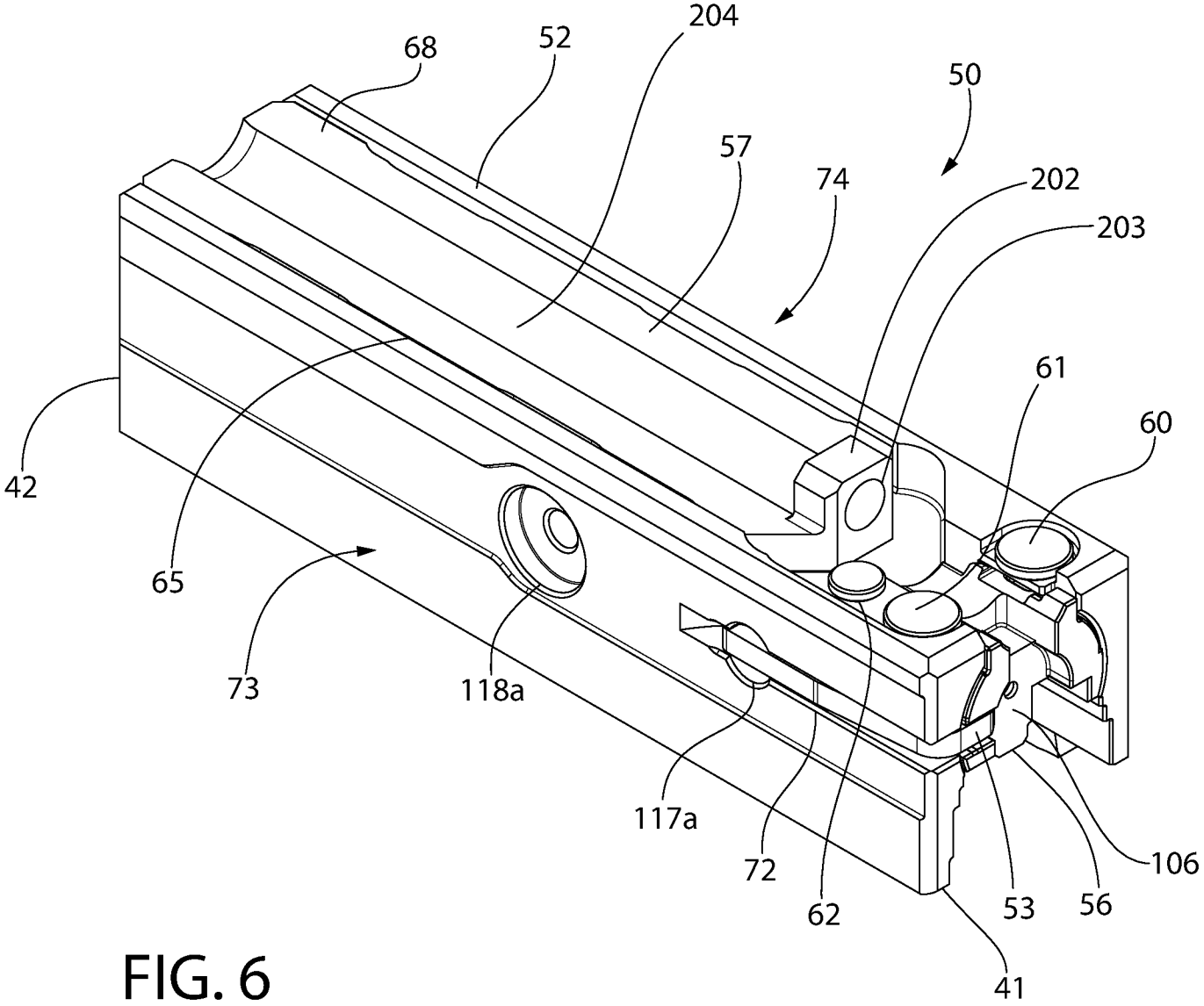
FIGS. 6 and 7 are right and left perspective views of the bolt assembly of FIG. 1 including a dead blow weight assembly.
Figure 7:
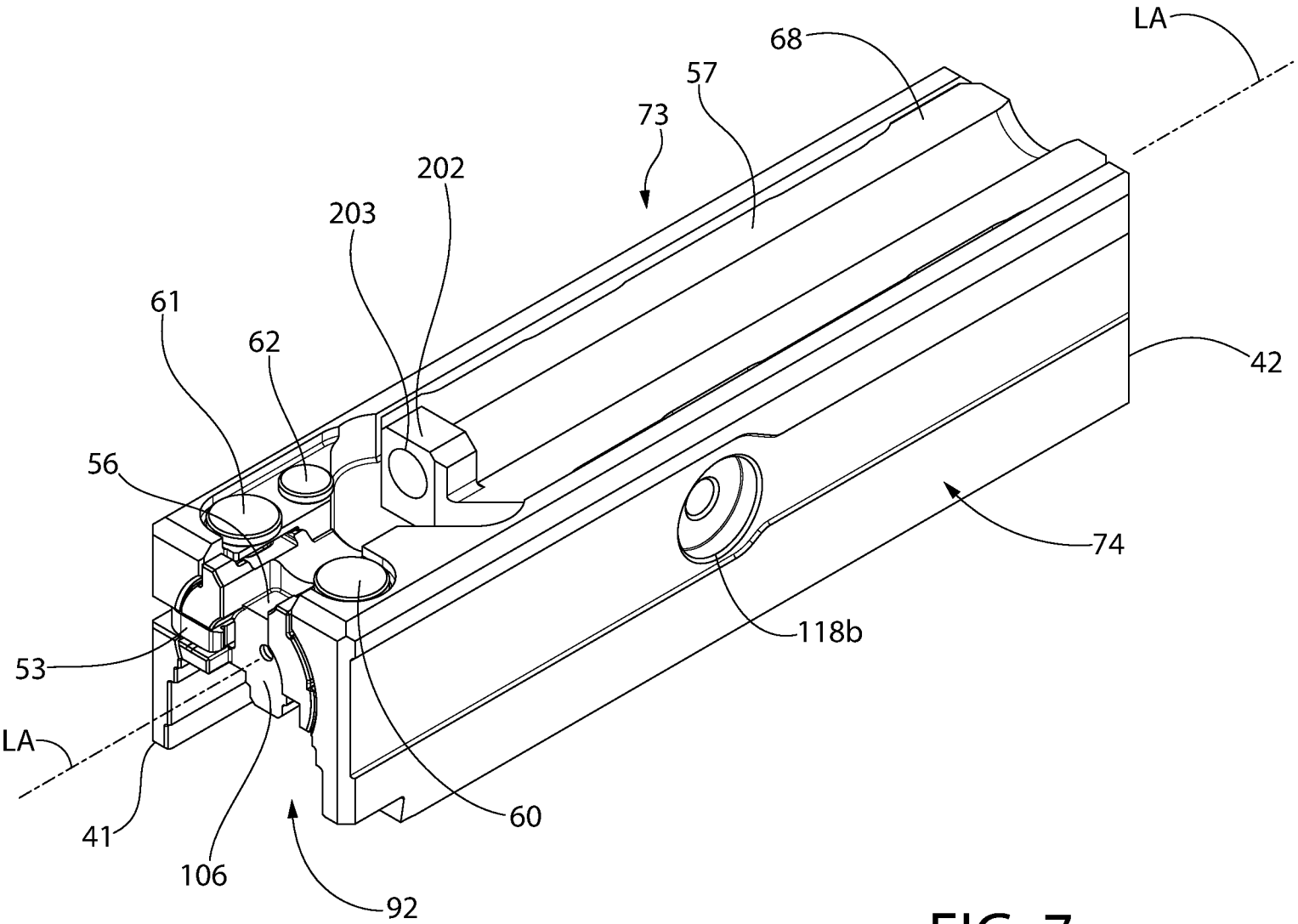
Figure 8:
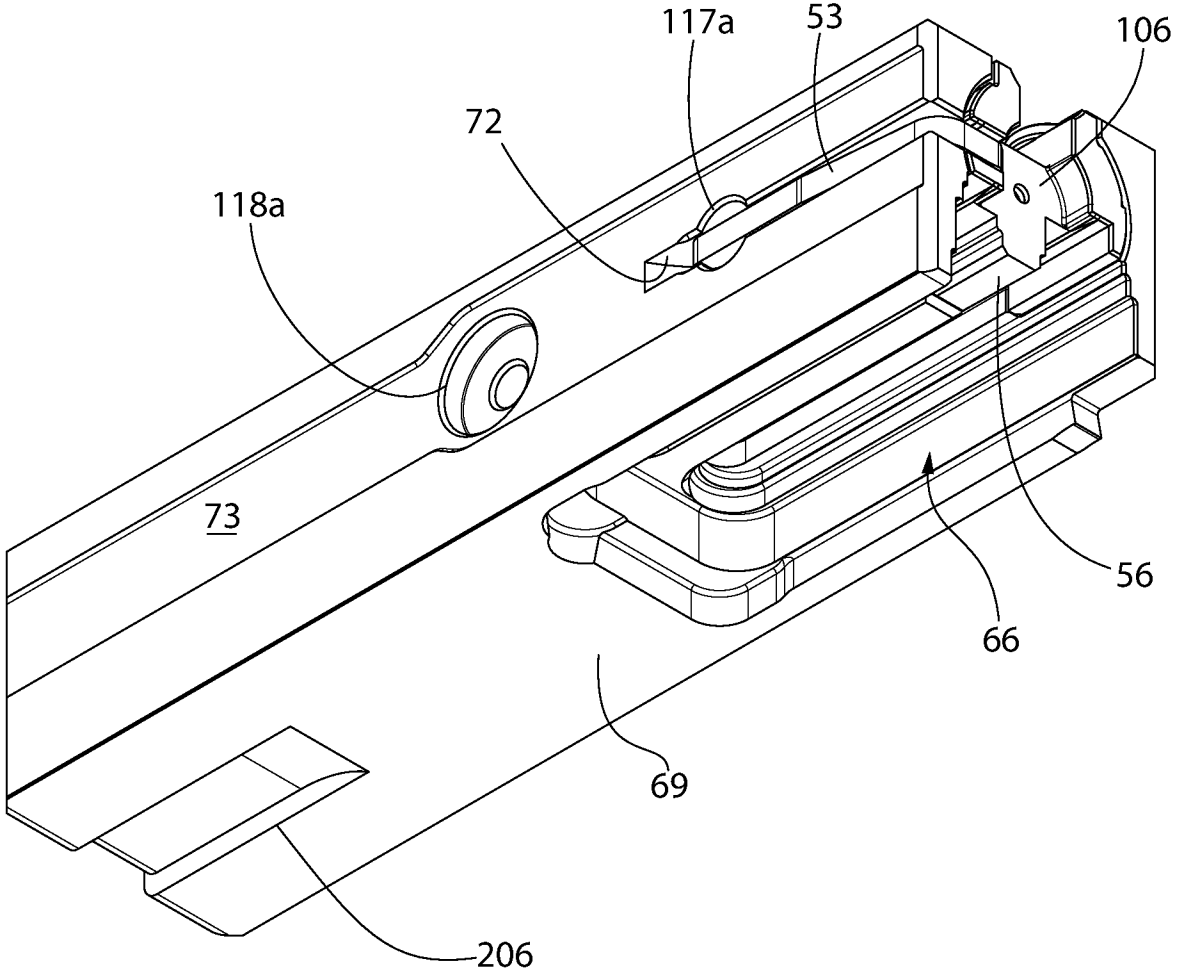
FIG. 8 is a bottom front perspective view thereof.

According to one aspect of the present disclosure, the bolt 52 and receiver 21 are constructed to provide an ambidextrous bolt handle 51 which allow the bolt handle to be mounted on either the right or left lateral side of the firearm to suit a right or left handed user. Referring to FIGS. 1 and 2 showing the right and left sides of the firearm 20 respectively, the receiver 21 on both sides includes an axially elongated handle slot 119*a*, 119*b* through which bolt handle 51 protrudes when mounted in a corresponding bolt handle socket 118*a*, 118*b* formed on opposite lateral sides of the bolt 52 (see also FIGS. 6 and 7). The bolt handle is shown mounted on the left side of the firearm 20 in the illustrated embodiment, but therefore can readily be positioned instead on the right side. Bolt handle 51 may be mounted to bolt 52 by any suitable means, including without limitation detachable mounting methods such as threaded engagement or pins to allow a user to switch the firing platform to left or right handed. In other implementations, for initial assembly of the firearm at the factory, the dual sided mounting options for the bolt handle may be used for fabricating and assembling a left or right handed firearm with the bolt handle being removably or permanently attached to the bolt on one side or the other.

FIGS. 6-15 depict various views of the bolt assembly 50 removed from the firearm. Bolt assembly 50 generally includes bolt 52, extractor 54, firing pin 30, firing pin spring 55, cartridge seat insert 56, and a dead blow weight assembly 59.

FIGS. 28-33 depicts various views of the body of the bolt 52 alone. Referring to FIGS. 6-15 and 28-33, bolt 52 has an axially elongated block-like body of generally rectilinear (e.g. rectangular cuboid) shape and includes front end 41, rear end 42, and right and left lateral sides 73, 74 extending between the ends. Bolt 52 defines an upwardly open upper chamber 65 extending for about half or a majority of the length of the bolt, and a downwardly and forwardly open lower chamber 66 of shorter length disposed proximate to front end 41 of the bolt. Lower chamber 66 provides open space and clearance for receiving the upper portion of magazine 33 when the magazine is fully mounted in the magazine well 32 (see also FIG. 5). Upper chamber 65 is disposed between the front and rear ends 41, 42 of the bolt 52, but may not penetrate the front and rear ends in some embodiments as illustrated. Upper chamber 65 includes a vertically deeper or taller rear section 65*a* and a vertically shallower or shorter front section 65*b* truncated at the bottom by horizontal partition wall 67 which extends axially forward from the rear portion. Partition wall 67 is spaced between the top and bottom 68, 69 of the bolt 52, and slideably supports and engages the underside of the front portion of dead blow top member 58 for forward and rearward axial movement thereon. Dead blow weight 57 is inserted and slideably disposed in deeper rear section 65*a* of the upper chamber 65 when assembled to the bolt. The rear section 65*a* thus defines an upwardly open receptacle 210 which receives the dead blow weight 57. Accordingly, the rear section 65*a* of upper chamber 65 has a complementary shape and dimensions in configuration to the dead blow weight. The dead blow weight 57 provides the "slide mass" for the blowback type action of the present firearm, as further described below.

The shallower front section 65*b* of the upper chamber 65 slideably receives the front portion of dead blow top member 58. The rear portion of dead blow top member 58 is positioned in the upper part of the rear section 65*a* of upper chamber 65 above the dead blow weight 57. The rear portion of the bolt bottom 69 may include a longitudinal hammer slot 206 (see, e.g. FIGS. 8 and 13) which receives and slideably engages the hammer 27 during recoil to recock the hammer when the action is cycled after discharging the firearm.

Firing pin 30 is slideably disposed in a cylindrical axial bolt bore 64 in the bolt body which extends between the front and rear ends 41, 42 of the bolt 52. In one embodiment, bolt bore 64 has a rear opening which opens through rear end 42 of bolt 52 and a front opening which opens through the front end 41 of the bolt (best shown in FIG. 15). The rear end of the firing pin 30 protrudes beyond the rear end of the bolt through hole 313 for contact by the released hammer 25 when the trigger 24 is pulled to discharge the firearm. An intermediate portion of the firing pin 30 between the front and rear ends passes completely through the deeper rear section 65*a* of upper chamber 65 and receptacle 210. The front opening of the bolt bore 64 is in communication with the through passage 97 formed in removable cartridge seat insert 56. The front end of the firing pin 30 may be positioned within through passage 97 as illustrated. Firing pin spring 55 is also disposed in the bolt bore 64 and is arranged to engage annular flange 70 on firing pin 30 when thrust forward by a hammer strike on the rear end of the pin. This returns the pin rearward after discharging the firearm 20.

Figure 9:
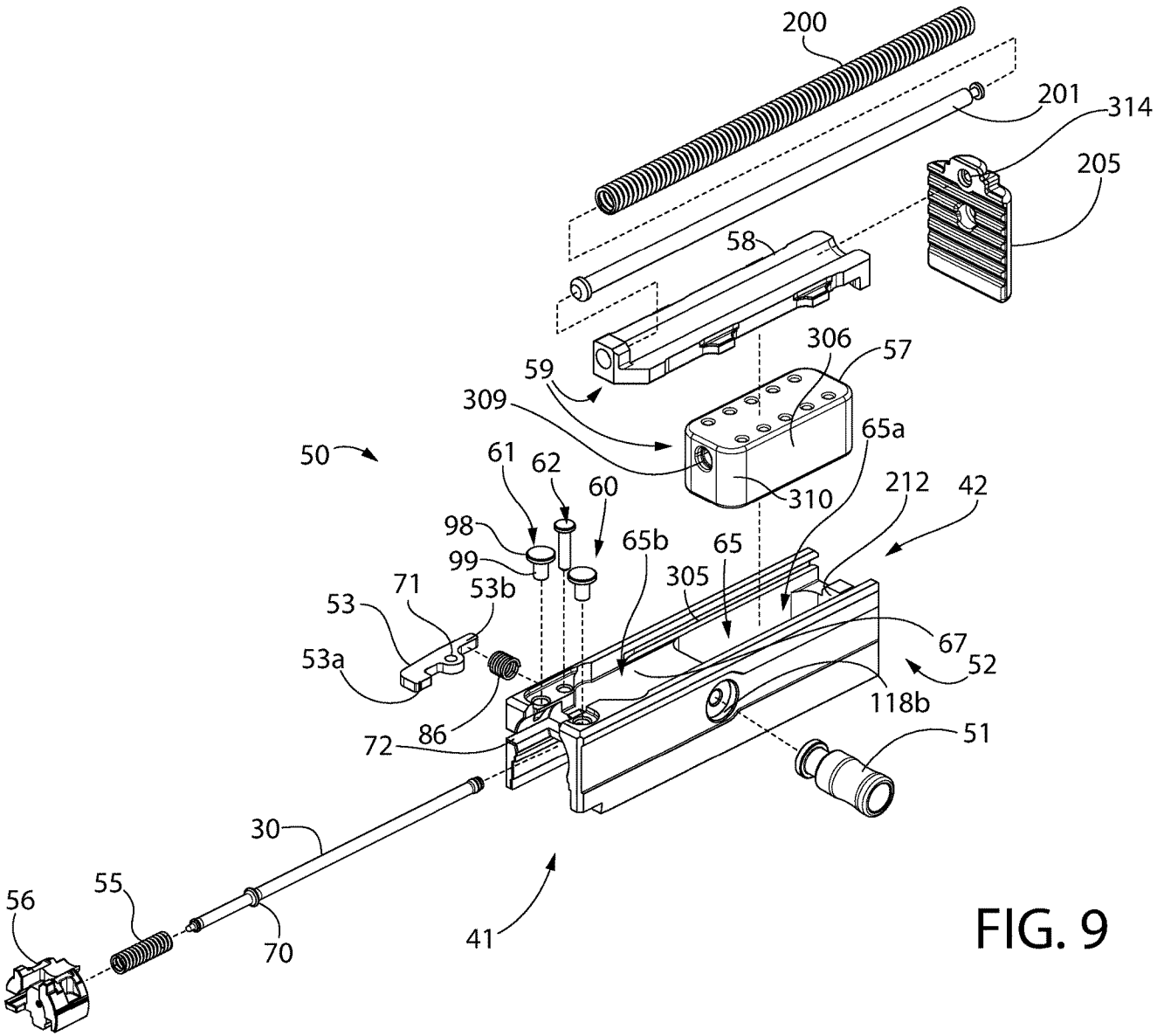
FIG. 9 is an exploded view thereof.

The extractor 53 has a generally flat plate-like structure and includes a hooked front end 53*a*, opposite rear end 53*b*, and a pivot hole 71 disposed between the ends for receiving a first pull pin 62 (best shown in FIG. 9). Pin 62 pivotably mounts the extractor to the bolt 52 in an axially extending horizontal slot 72 formed in the right lateral side 73 of the bolt. Pivot hole 71 and pull pin 62 may be disposed approximately midway between the front and rear ends of the extractor 53 in some embodiments. In one embodiment, slot 72 may extend partially rearward along the length of the bolt from the front end 41 towards the rear end 42 of the bolt body as illustrated. In this arrangement, slot 72 penetrates the front end of the bolt 52 as shown.

Pull pin 62 is received in a vertical hole pin 87 extending from and penetrating the top surface of the top 68 of the bolt 52 downward to and communicating with horizontal slot 72. Hole 87 is positioned rearward from the the front of the slot 72 on the right lateral side 73 of bolt to access the pivot hole 71 in the extractor 53. The bottom end of pin 62 is positioned in the slot 72, and in some embodiments may extend below the slot in arrangements where hole 87 extends vertically below the slot in the bolt body. The bottom portion of pin 62 extends through hole 71 in the extractor 53 to pivotably mount the extractor to the bolt 52.

Both the slot 72 and extractor 53 are horizontally aligned with the longitudinal axis LA and barrel bore 37 to place the hooked front end 53*a* of the extractor at approximately mid-height of a cartridge C when positioned in the barrel chamber 36 for extraction from the chamber. A laterally oriented extractor spring 86 mounted in the right lateral side 73 of the bolt 52 biases the rear end 53*b* of the extractor 53 outwards thereby rotating the front hooked end 53*a* inwards to engage the rim of the chambered cartridge C. Spring 86 in one non-limiting embodiment may be a coiled compression spring which is disposed in a laterally open spring hole 117*a* which intersects and is arranged perpendicular to the horizontal slot 72 in the bolt 52. It will be appreciated that other types of springs or spring mechanisms may be used Pull pins 60-62 in one embodiment include a lower cylindrical shank 99 and diametrically enlarged head 98 at the top of the shank. When the pull pins are fully inserted into the bolt 52, the heads 98 of the pins abuttingly engage the top surface of the bolt when properly and fully mounted therein. This ensures that pins 60-62 have been inserted to a depth sufficient to secure the extractor 53, ejector 54, and cartridge seat insert 56 to the bolt assembly 50. In addition, the enlarged heads 98 facilitates removal of the pins 60-62 via a tool having a flat working end (e.g. slotted fastener screw driver or other) which can be used to pry the pins upward for extractor from their respective vertical pin mounting holes. In some embodiments, the cartridge seat insert pull pin 61 may have a shank 99 with a cross-sectional shape other than cylindrical, as further explained elsewhere herein.

According to an aspect of the invention, cartridge seat insert 56 detachably mounts to the front end 41 of the bolt assembly 50 to allow the bolt 50 to accommodate and chamber a plurality of different types of cartridges via using a suitably configured seat insert. Advantageously, the removable cartridge seat allows for: 1) More flexible manufacturing by allowing caliber change through a less expensive insert rather than a complete bolt; 2) Reduces critical dimensions to the smaller less expensive component for matching a particular cartridge's dimensional requirements necessary to properly support the base of the cartridge and allow for its extraction during and after firing the firearm; and 3) Allows the end user an option to easily change calibers through the exchange of the relatively inexpensive replaceable component.

FIGS. 16-20 depict the replaceable cartridge seat insert 56 alone. The cartridge seat insert 56 can be considered to form a removable "bolt head" for engaging and forming a closed breech with the barrel (albeit a bolt head without any locking lugs typical for a blowback action). Referring now to the bolt assembly in FIGS. 6-15 and the cartridge seat insert in FIGS. 16-20, cartridge seat insert 56 includes a front end 95, rear end 96, a laterally broadened front seating portion 90, and part-cylindrical cantilevered rear extension 91 projecting rearwardly therefrom. Rear extension 91 is received and seated in a forwardly open socket 300 formed in the bolt 52 (see, e.g. FIG. 15). An axial circular through passage 97 horizontally extends completely through the cartridge seat insert from the front end 95 to rear end 96 for slideably receiving the forward portion of firing pin 30 therethrough. The cartridge seat insert 56 is slideably insertably received in a forwardly open axial mounting receptacle 93 in bolt 52 and is coaxially aligned with the longitudinal axis LA of the firearm. Mounting receptacle 93 communicates with and is axially aligned with the circular axial firing pin bore 64 in the bolt 52 (see, e.g. FIG. 15).

A pair of upwardly open vertical slots 94 are formed in stem 91 on each lateral side of cartridge seat insert 56 and receive second and third pull pins 60, 61 therethrough for removably locking the cartridge seat insert 56 in mounting receptacle 93 of the bolt 52. Slots 94 are laterally spaced apart on opposite sides of the firing pin through passage 97 in cartridge seat insert 56. Pull pins 60, 61 are received in vertical pin holes 88, 89 extending downwards through the bolt body from and penetrating the top surface of the top 68 of the bolt 52. Vertical pin holes 88, 89 communicate with cartridge seat mounting receptacle 93 in the bolt body and slots 94 in the cartridge seat insert 56 when positioned therein. The bottom ends of pins 60, 61 are received in the slots 94 when fully inserted in pin holes 88, 89. Holes 88, 89 are positioned near the front 41 of the bolt 52 and laterally offset from the longitudinal axis LA. Although the use of two laterally spaced apart pins 88, 89 provide stable mounting of the cartridge seat insert 56 in bolt 52 which resists twisting when the bolt recoils, it will be appreciated that in other embodiments a single pin and associated vertical slot may be used.

In one embodiment, slot 94 may be laterally open as well as upwardly open. The slot 94 may have a rectilinear or semi-circular cross-section (the illustrated embodiment showing the rectilinear configuration) which receives the cylindrical shanks 99 of pull pins 60, 61. In other possible embodiments, the shank of the pull pin 61 may have a cross-sectional shape other than circular including non-circular shapes such as rectilinear, hexagonal, or other. Because the cartridge seat insert 56 does not rotate or pivot horizontally about the vertical pin axis of pull pins 60, 61 unlike the extractor 53 associated with cylindrical pull pin 62, the shanks 99 of pins 60 and 61 do not require a circular cross-sectional to support rotational/pivotable motion. The cross-sectional shape of vertical slot 94 in some embodiments may therefore have a non-circular cross-sectional shape that complements the cross-sectional shape of shanks 99 of pull pins 60, 61.

The front seating portion 90 has a lateral width substantially greater than the rear extension 91 and is seated in axial mounting receptacle 93 which defines a forwardly open frontal recess 92 formed in the front of the bolt 52. The front recess 92 and mounting receptacle 93 may have a complementary configuration to seating portion 90 (see, e.g. FIG. 6-10). This helps lock the cartridge seat insert 56 in position to preclude rotation about the longitudinal axis LA. With additional reference to FIGS. 16-20), seating portion 90 includes a pair of an upper right wing segments 100 and lower right wing segment 102. The upper wing segments are vertically spaced apart from the lower wing segments defining a right channel 104 therebetween. The channel 104 communicates with right horizontal slot 72 in the bolt 52 to receive the extractor 53 at least partially therein respectively. Accordingly, channel 104 is transversely aligned and falls in the same horizontal plane as the right horizontal slot 72. In one non-limiting embodiment, as illustrated, the channel 104 may extend axially from the front to rear end of the front seating portion 90 of cartridge seat insert 56. Cartridge seat insert 56 further includes a downwardly open undercut slot 303 configured to receive an ejector (not shown) which is mounted in the receiver of the firearm. Slot 303 is forwardly and rearwardly open as well to accommodate the ejector.

Figure 10:
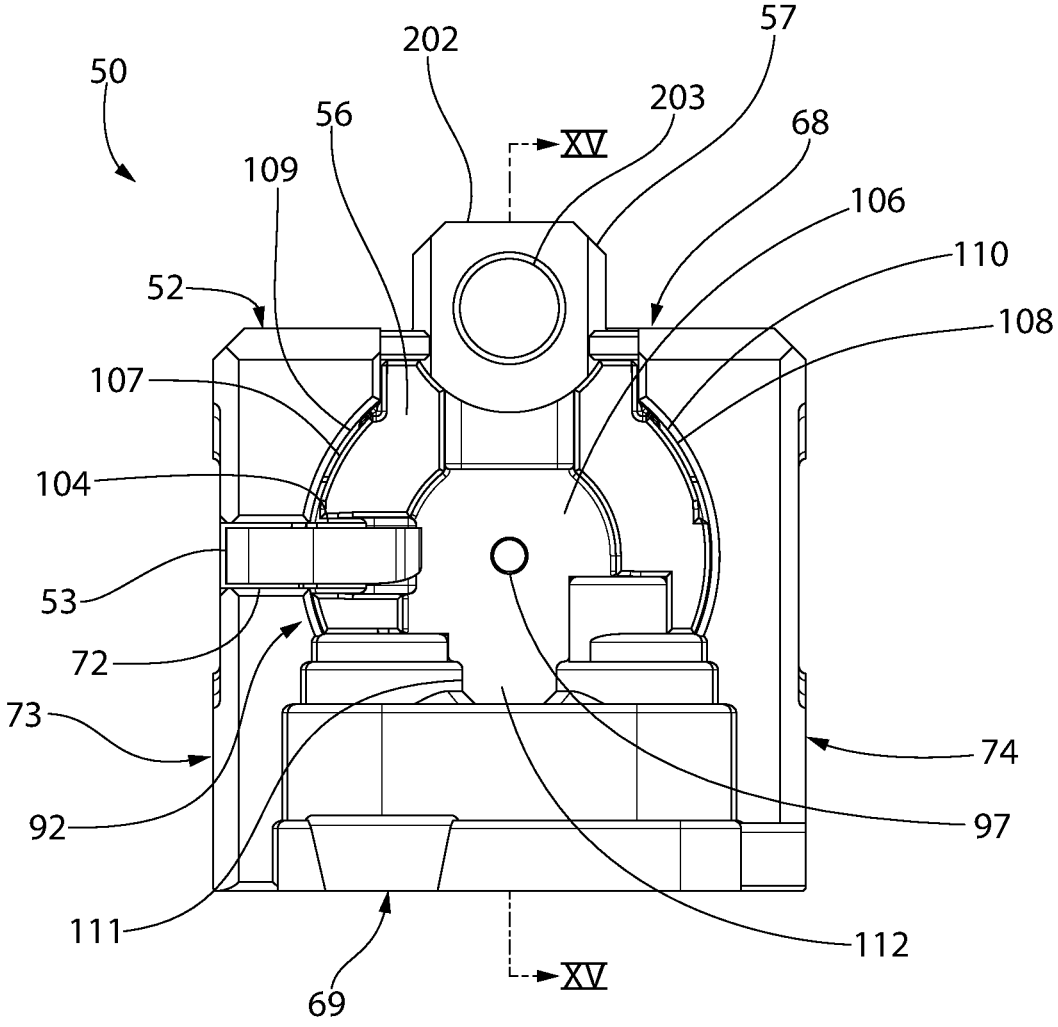
FIGS. 10 and 11 are front and rear end views thereof.
Figure 11:
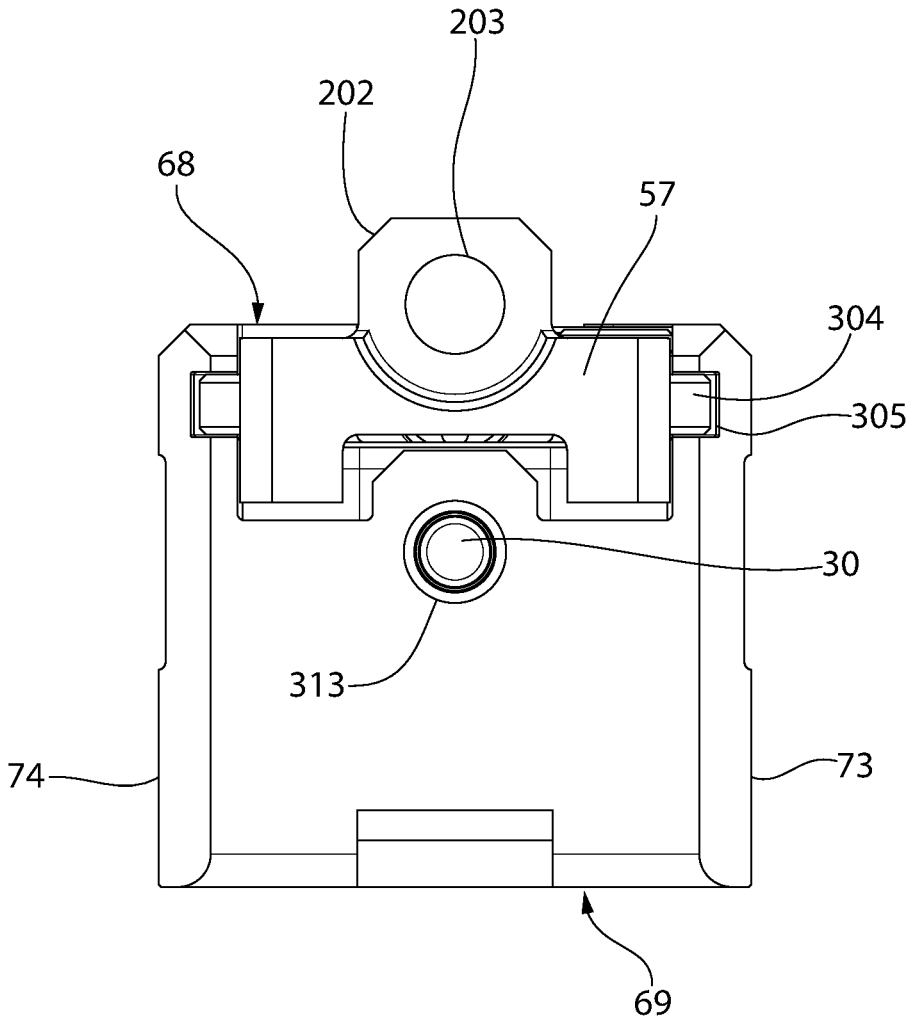
Figure 12:
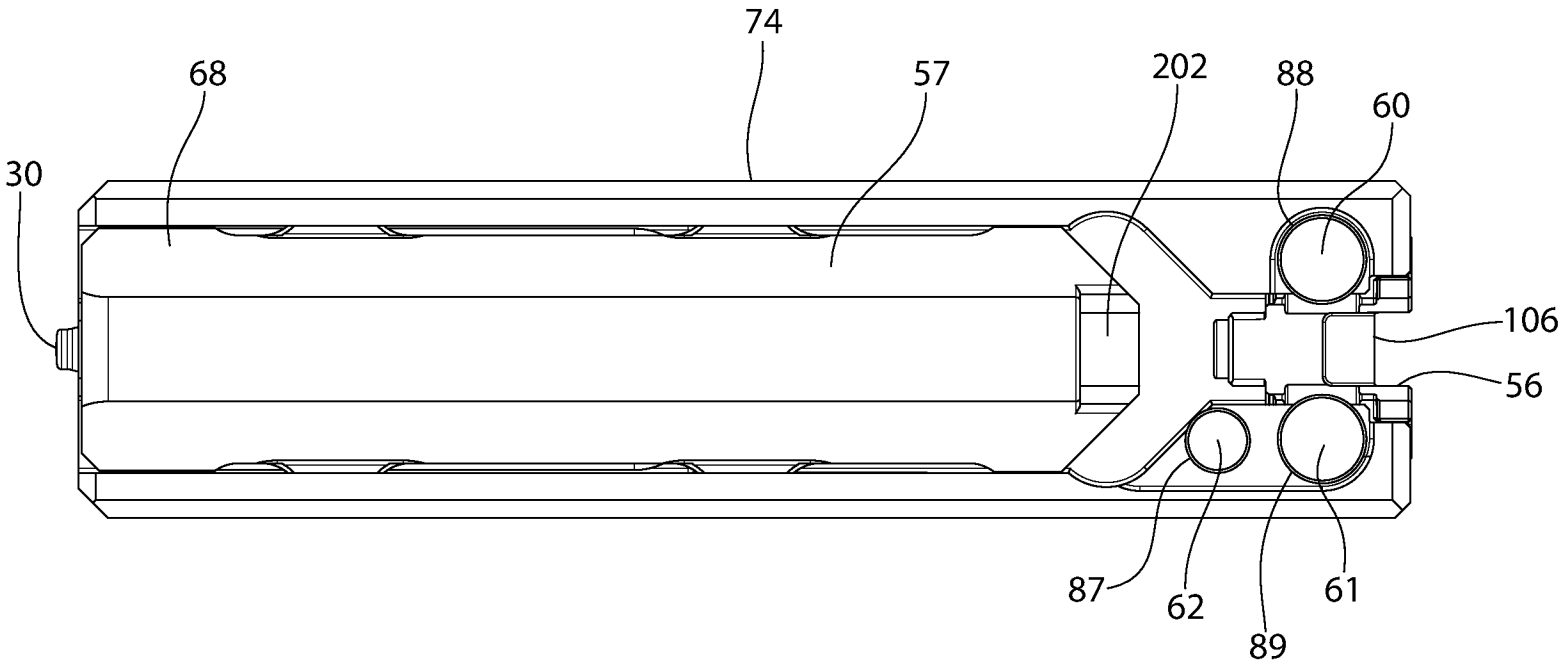
FIGS. 12 and 13 are top and bottom plan views thereof.
Figure 13:
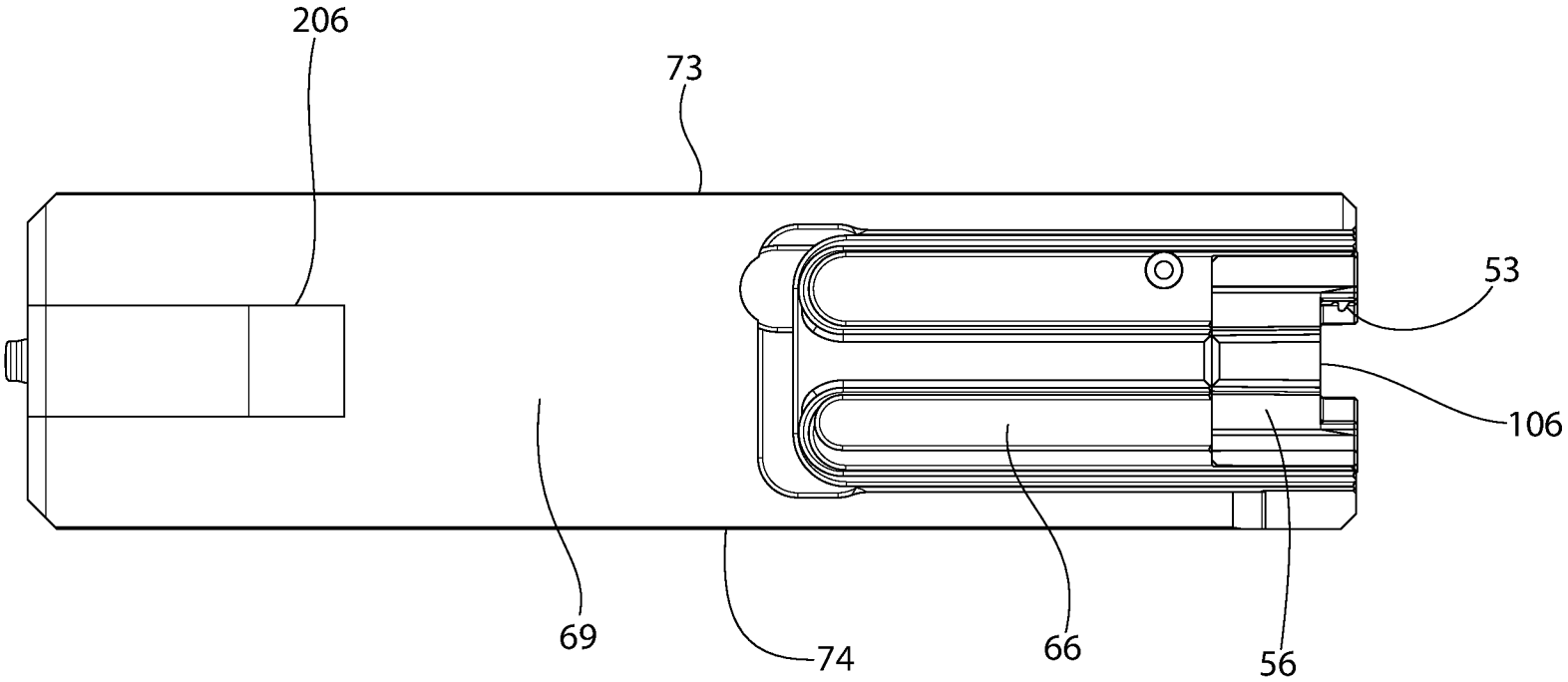
Figure 14:
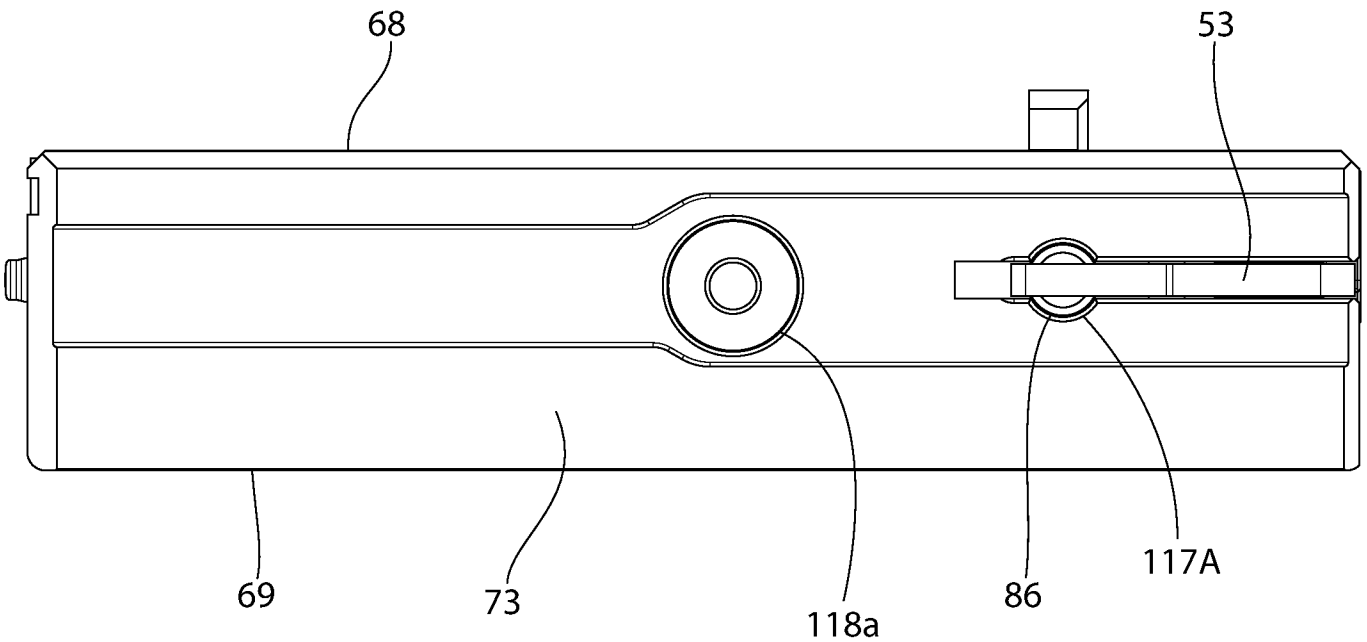
FIG. 14 is a right side view thereof.
Figure 15:
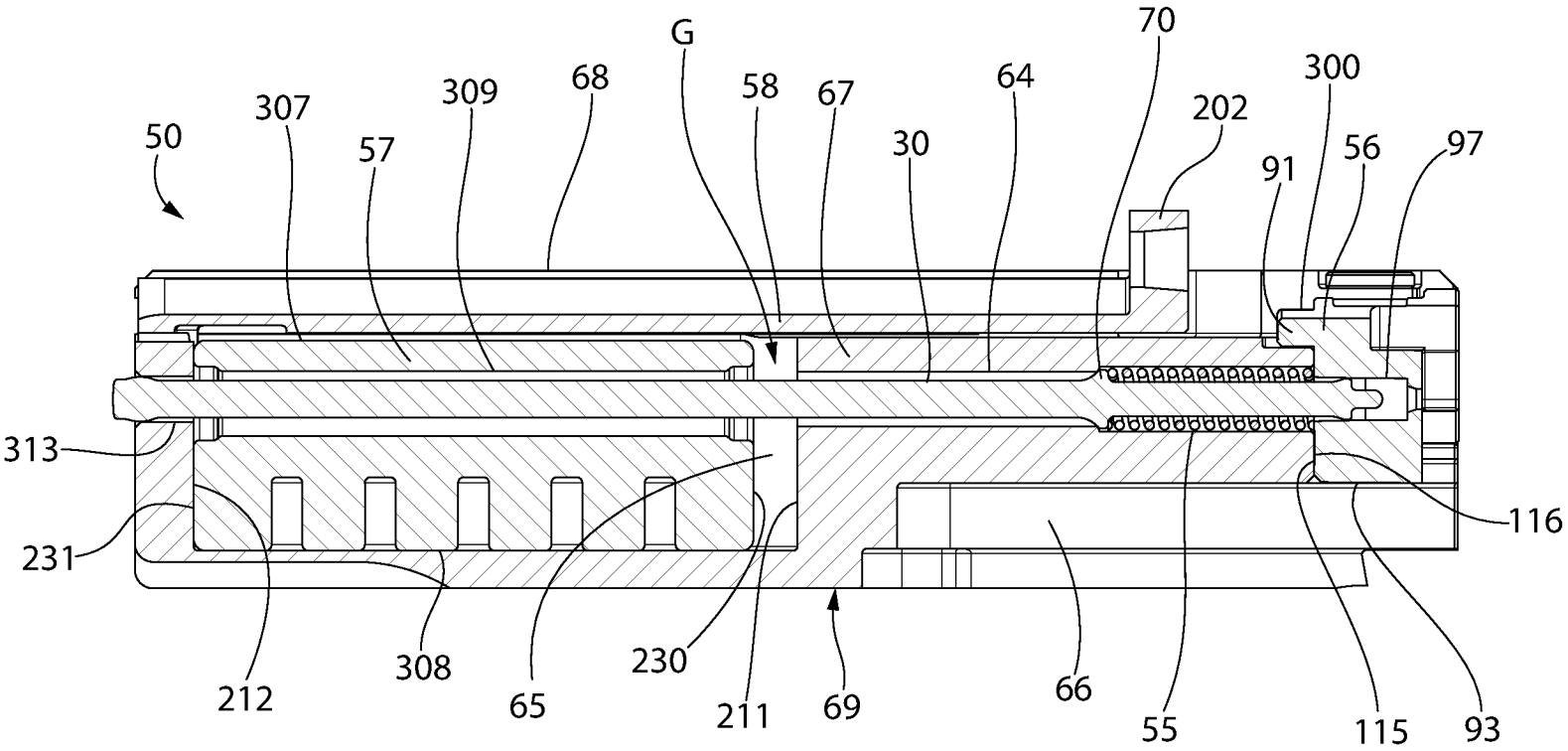
FIG. 15 is a longitudinal cross-sectional view of FIG. 14.
Figure 16:
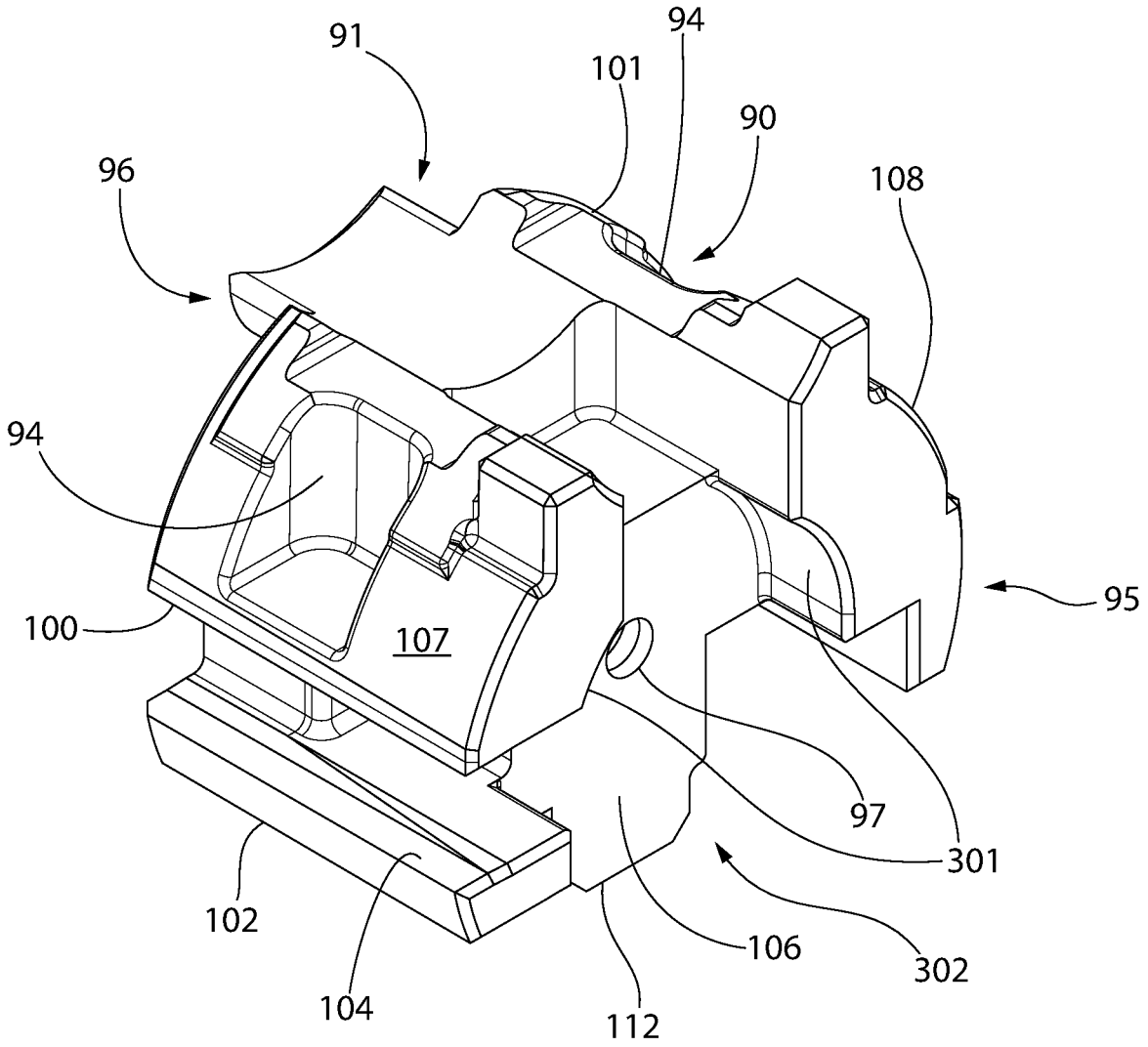
FIG. 16 is a front perspective view of a replaceable and interchangeable cartridge seat insert of the firearm of FIG. 1.
Figure 17:
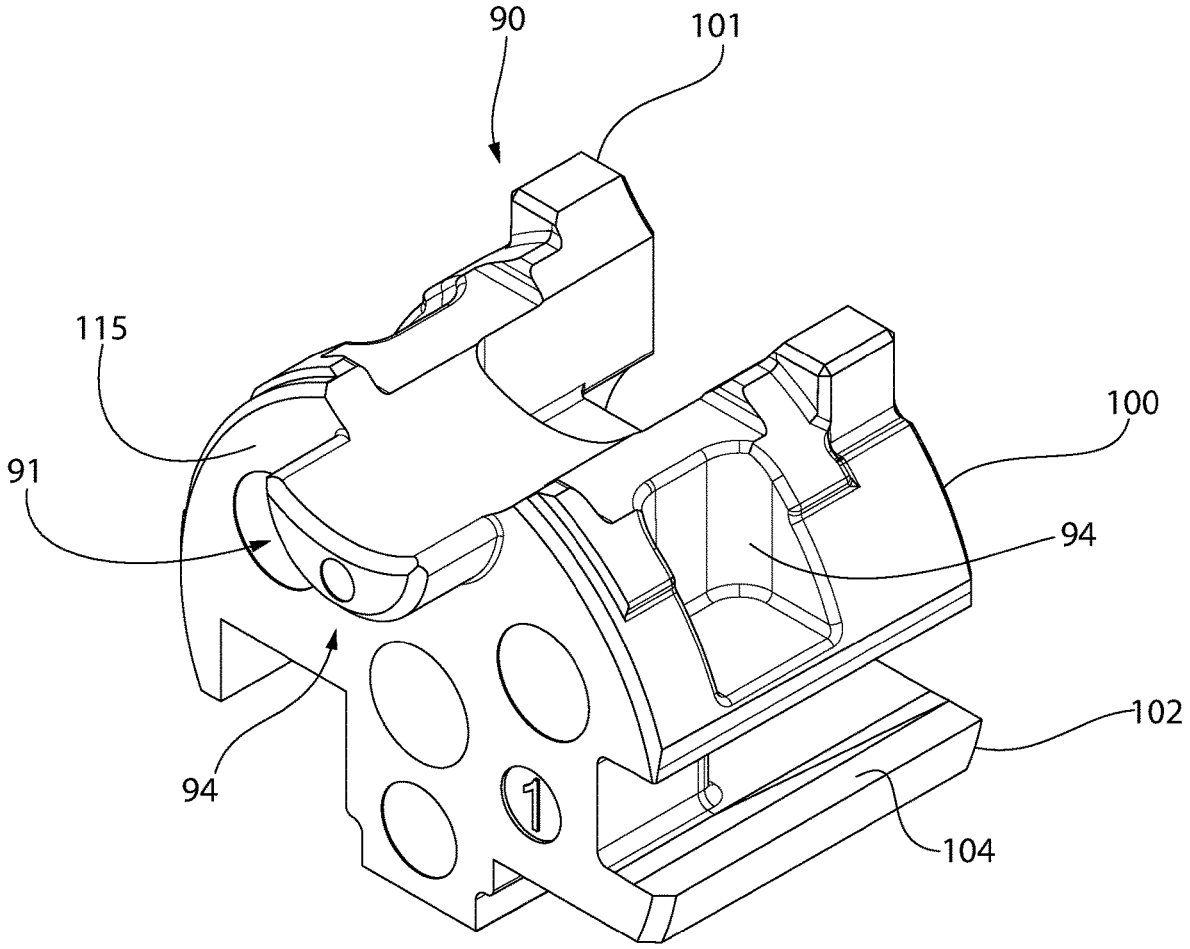
FIG. 17 is a rear perspective view thereof.
Figure 18:
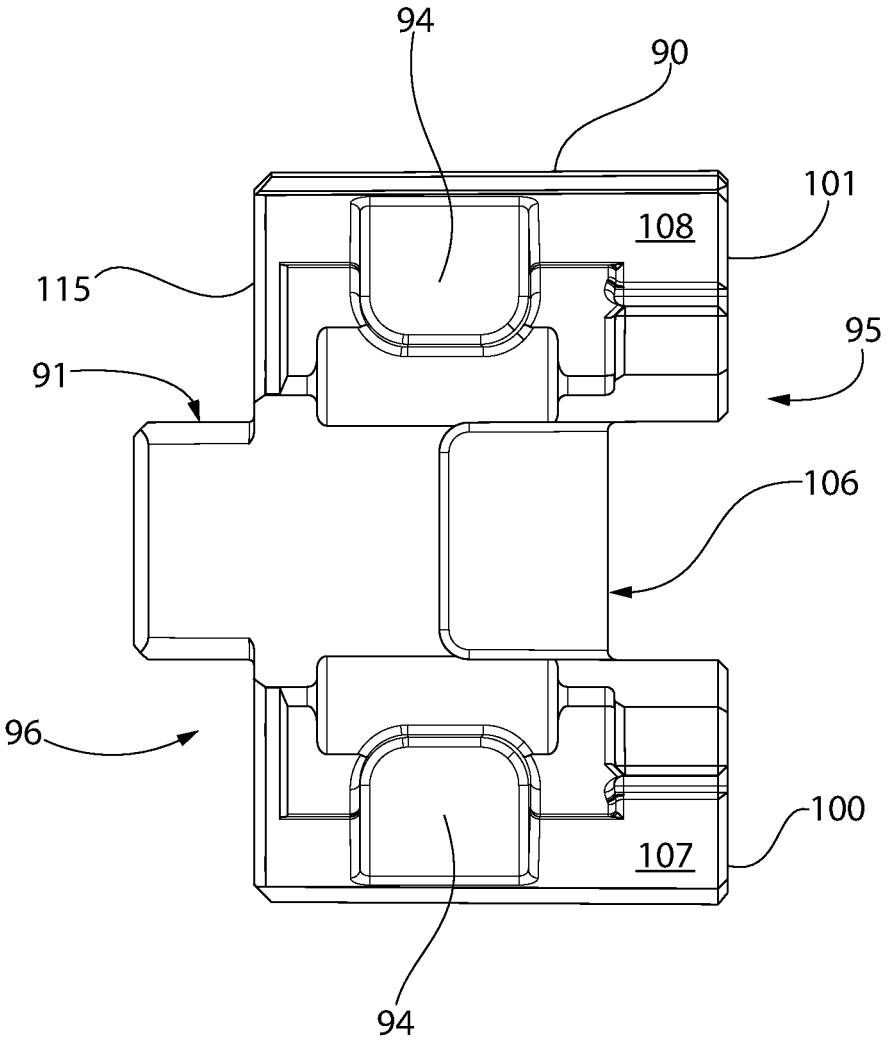
FIG. 18 is a top plan view thereof.
Figure 19:
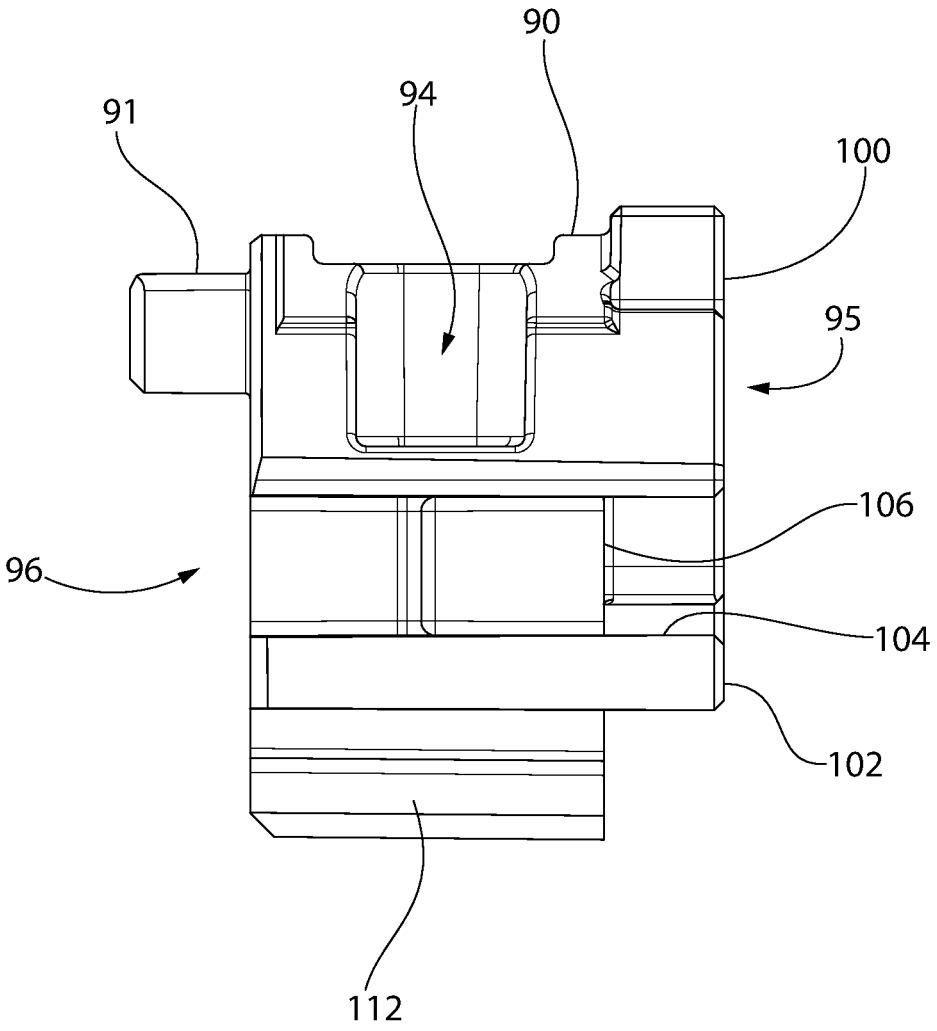
FIG. 19 is a right side view thereof.
Figure 20:
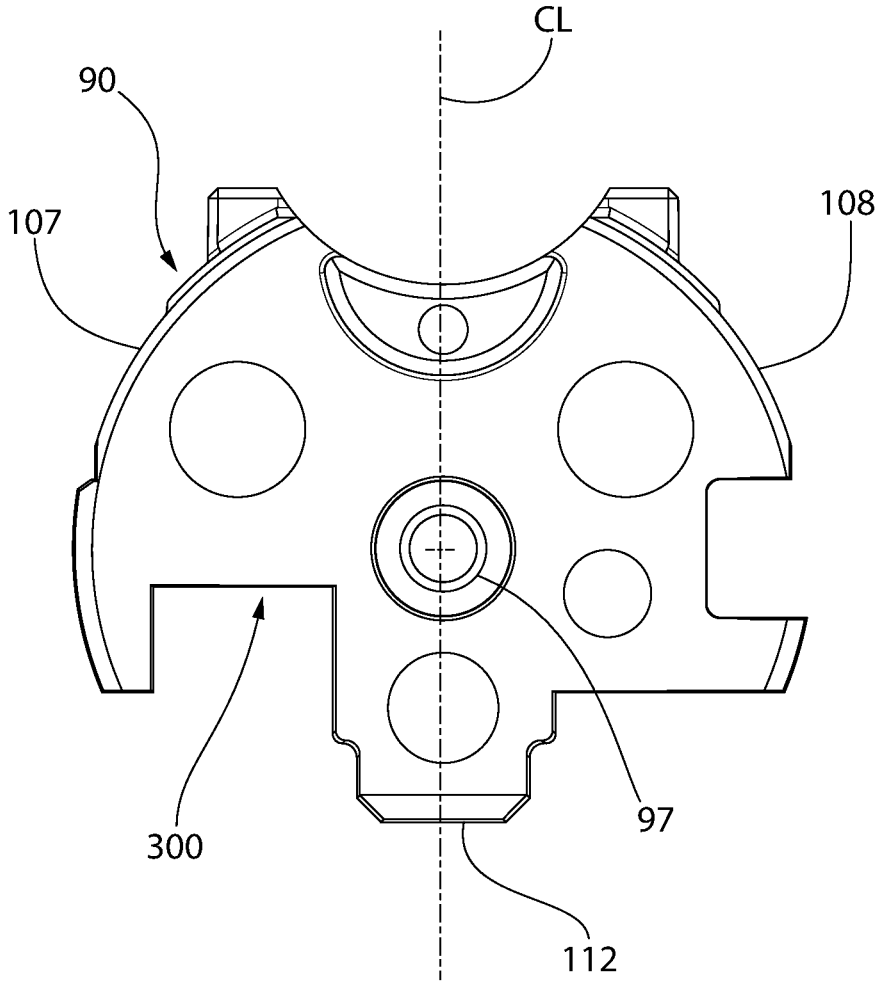
FIG. 20 is a front end view thereof.
Figure 21:
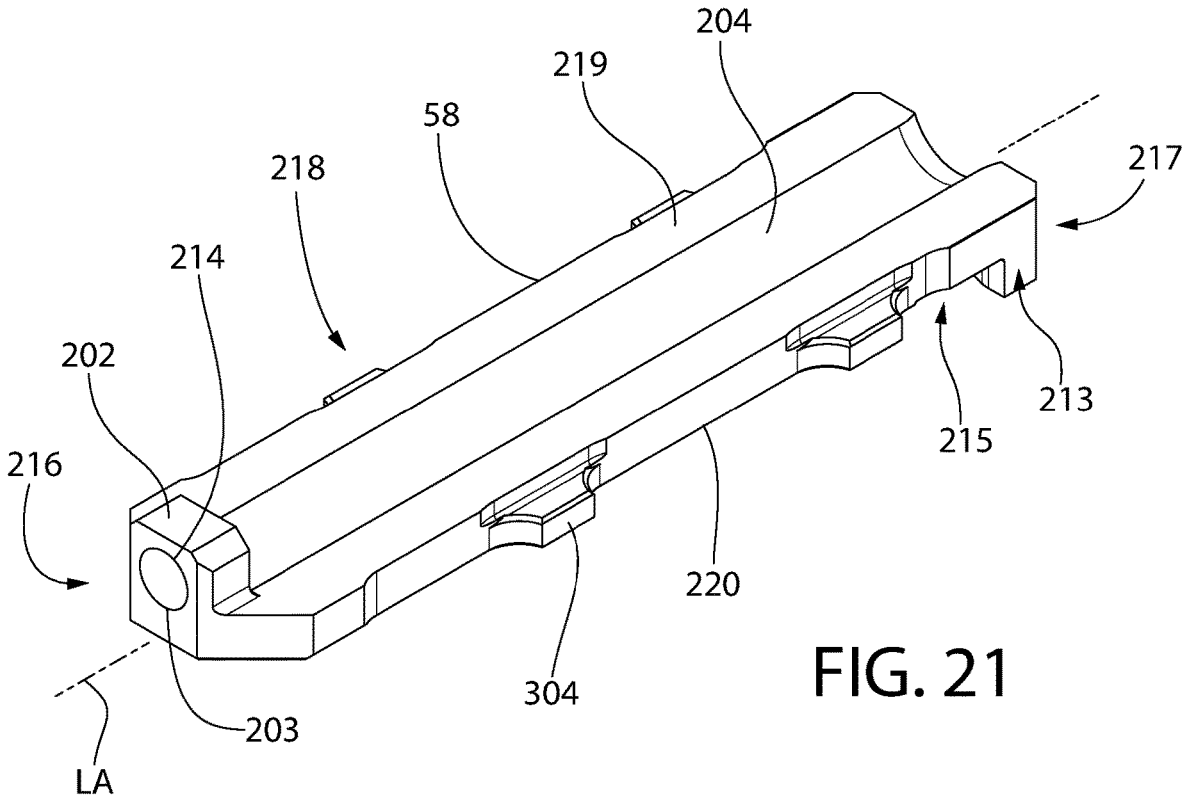
FIG. 21 is a top perspective view of a dead blow top member of the dead blow weight assembly of the bolt.
Figure 22:
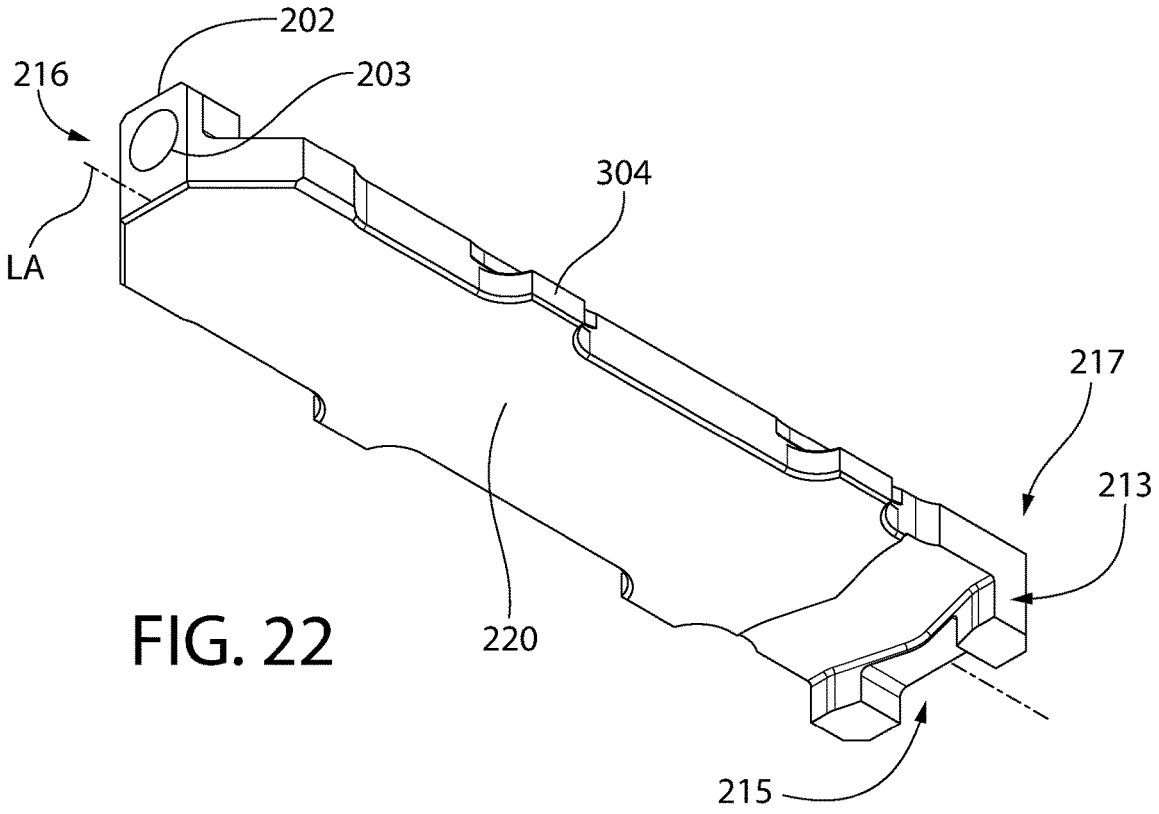
FIG. 22 is a bottom perspective view thereof.
Figure 23:
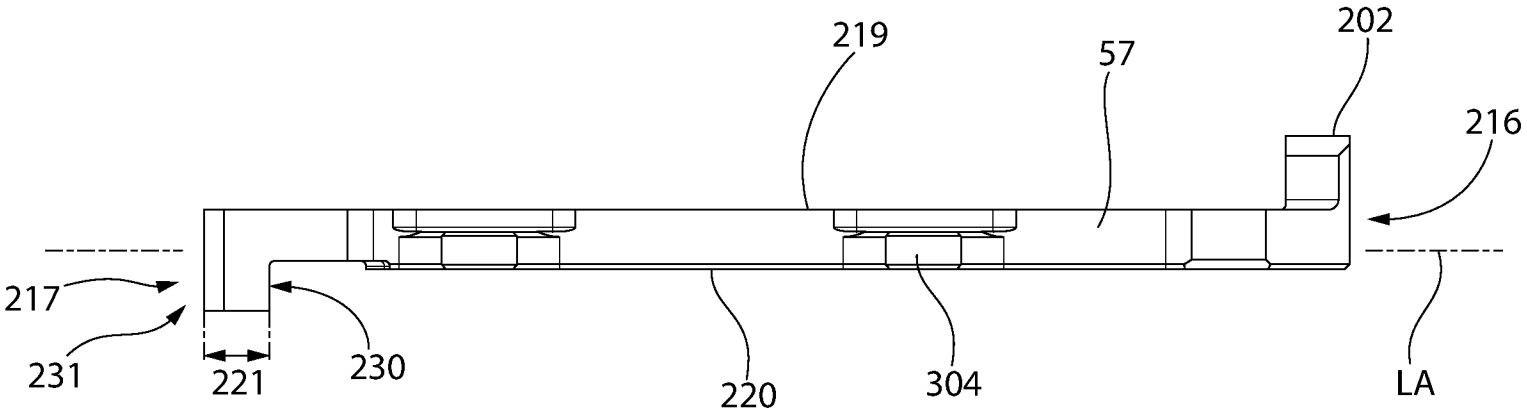
FIG. 23 is a side view thereof.
Figure 24:
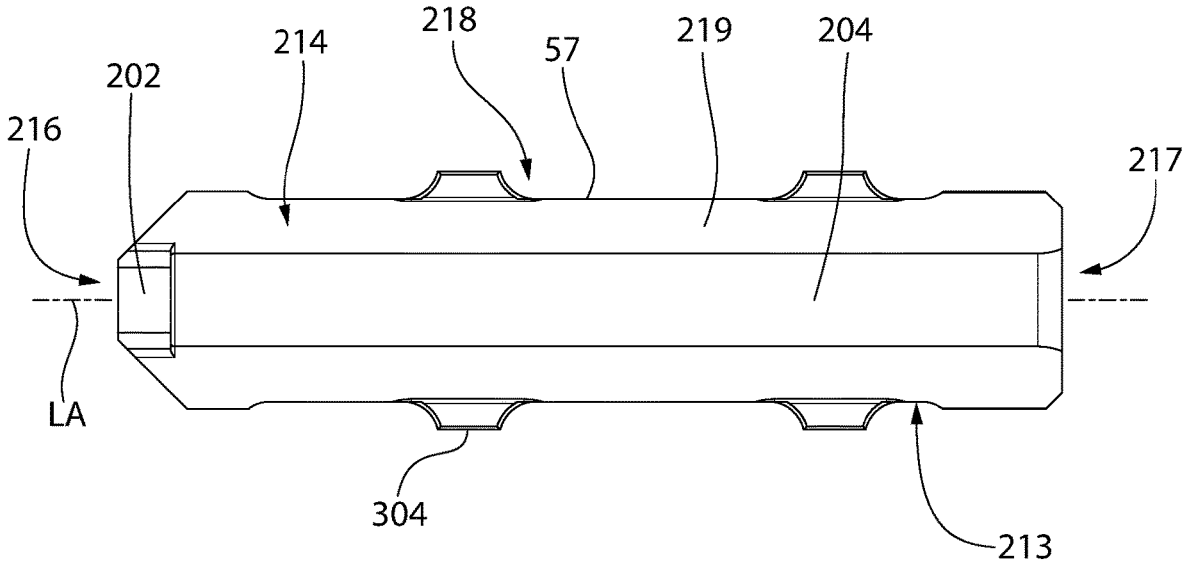
FIG. 24 is a top view thereof.
Figure 25:
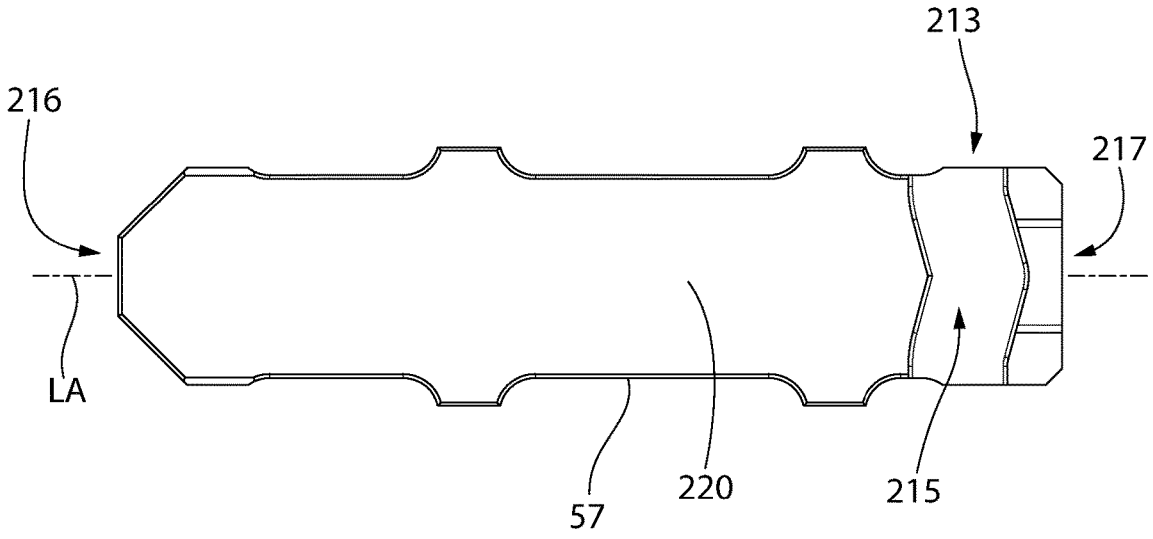
FIG. 25 is a bottom view thereof.
Figure 27:
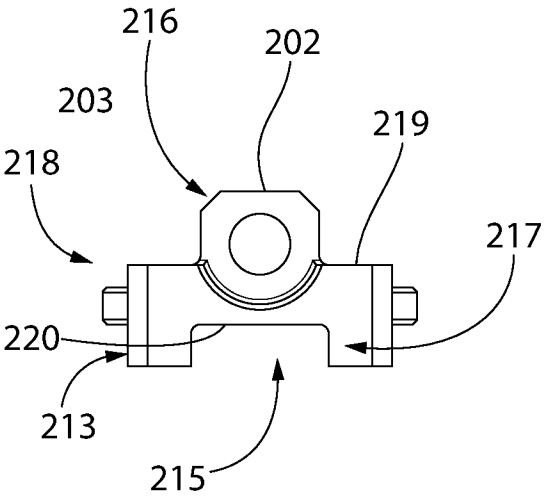
FIG. 27 is a rear end view thereof.
Figure 26:
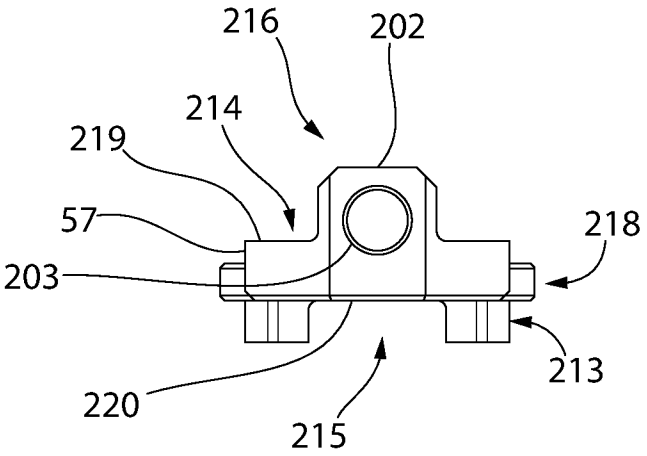
FIG. 26 is a front end view thereof.
Figure 29:
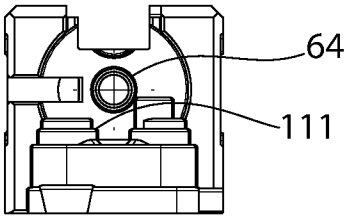
FIG. 29 is a front view thereof.
Figure 31:
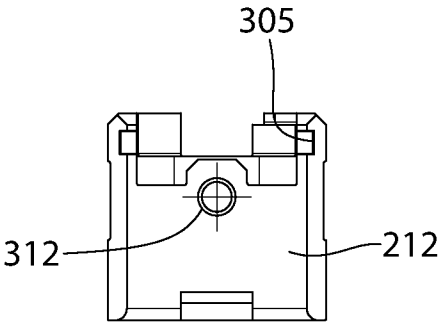
FIG. 31 is rear view thereof.
Figure 28:
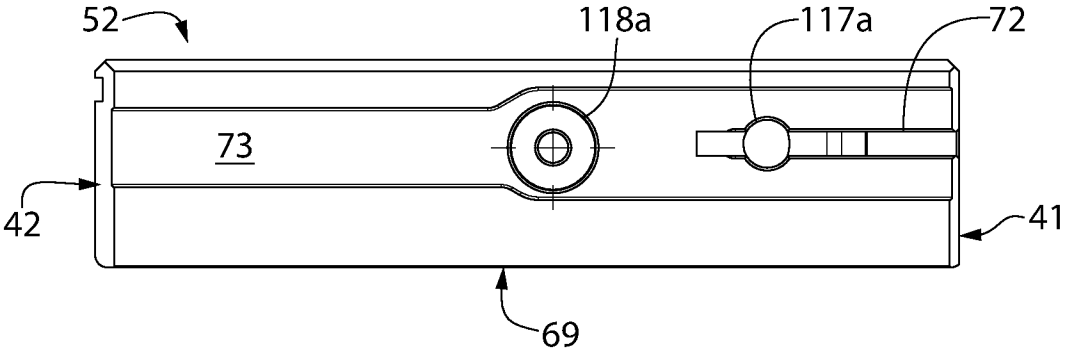
FIG. 28 is a right side view of the bolt body.
Figure 30:
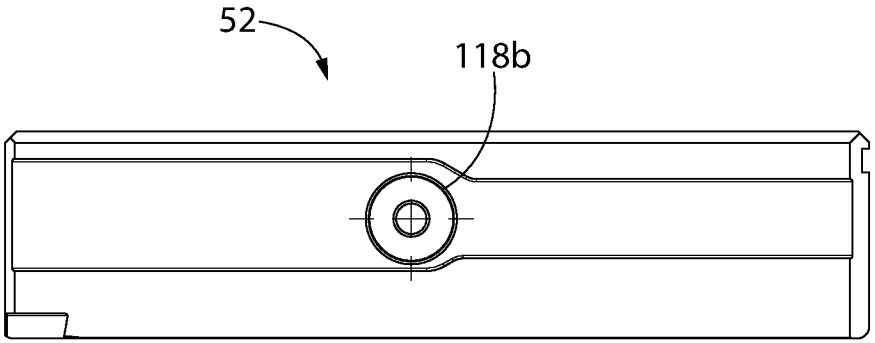
FIG. 30 is a left side view thereof.
Figure 32:
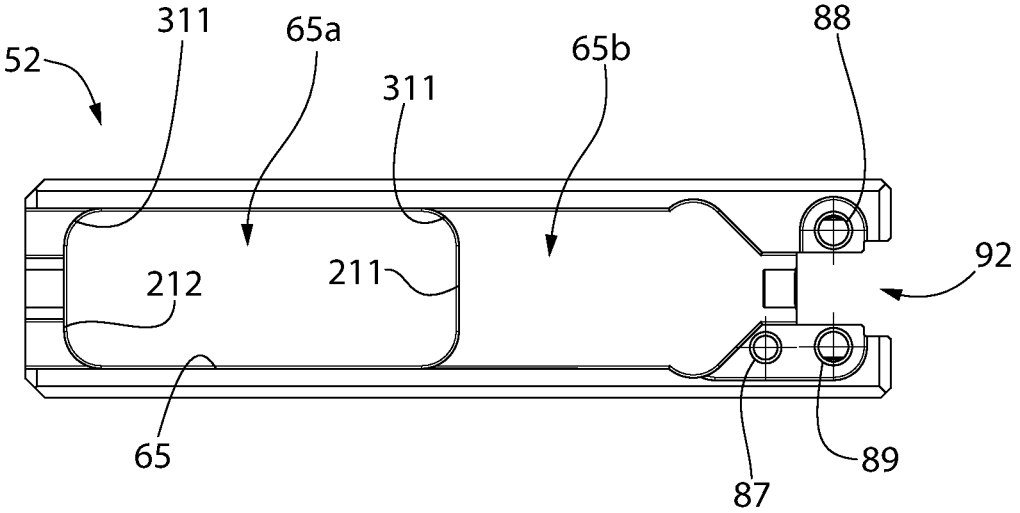
FIG. 32 is top plan view thereof.
Figure 33:
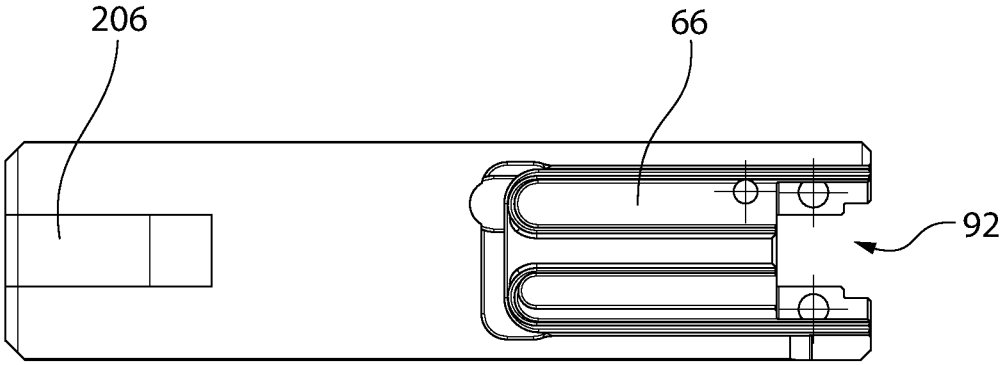
FIG. 33 is a bottom plan view thereof.
Figure 34:
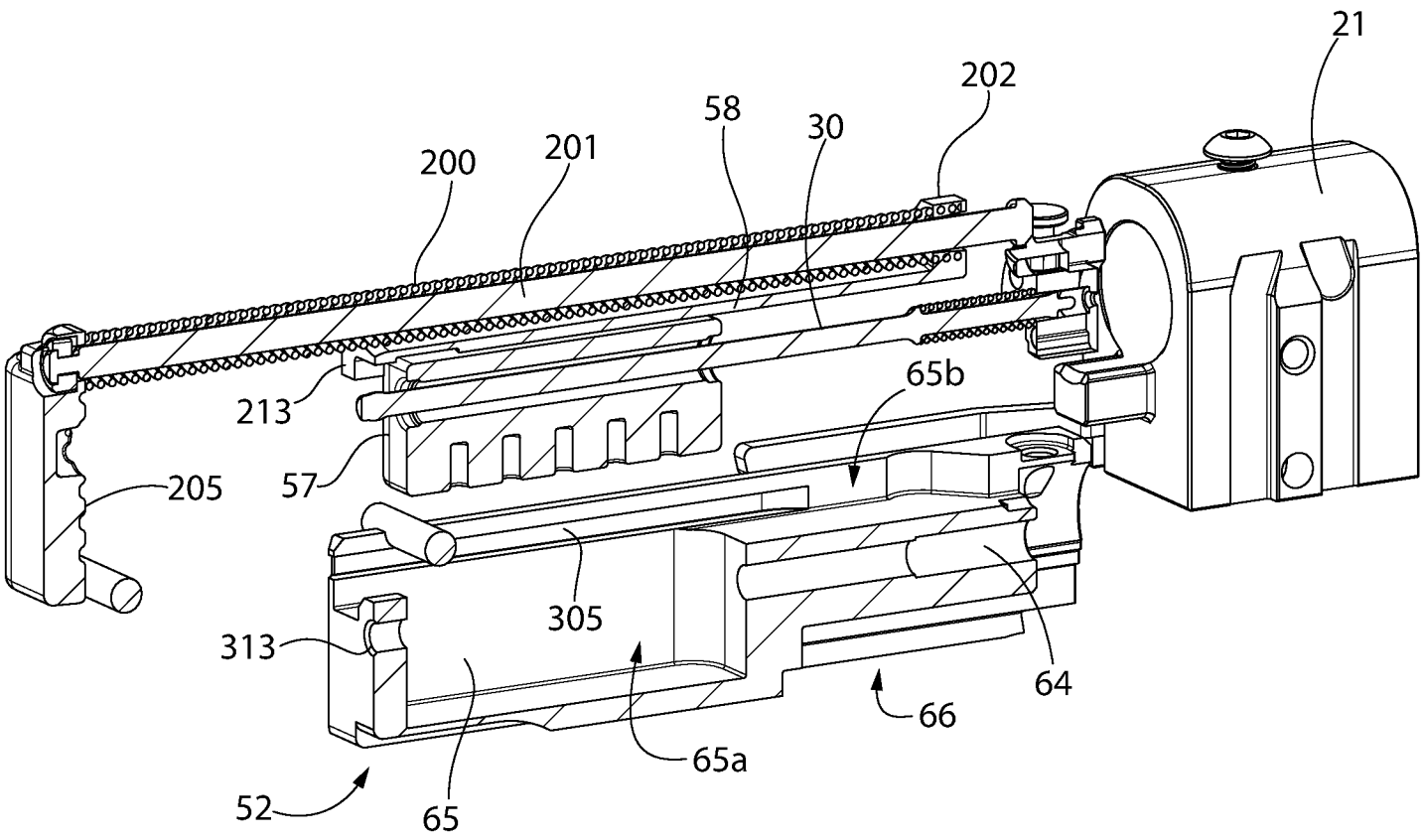
FIG. 34 is an exploded cross-sectional perspective view of the bolt and dead blow weight assemblies.
Figure 35:
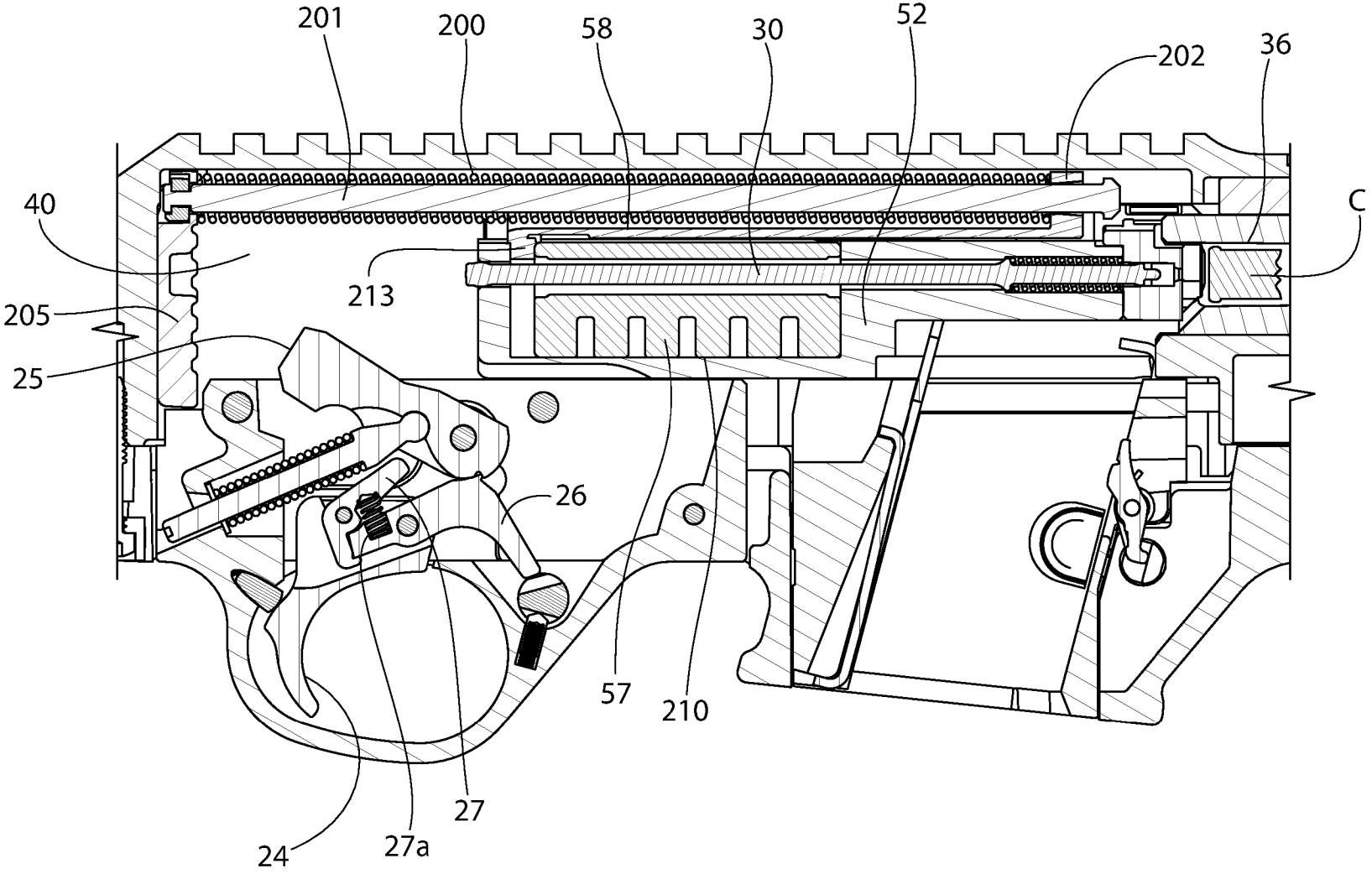
FIG. 35 is a first cross-sectional view of a sequential series of figures showing operation of the multi-piece blow-back-type bolt assembly according to the present disclosure.

The front seating portion 90 may further include a downwardly extending polygonal-shaped key 112 which is received in a complementary configured keyway 111 formed in the axial mounting receptacle 93 of the bolt body (see also FIG. 10). Key 112 may extend axially from rear end 96 to seating surface 106 of the cartridge seat insert 56. This key further provides an anti-rotation feature to ensure that the cartridge seat insert 56 remains positioned in the proper rotational orientation when mounted to the bolt 52. This feature helps to transversely align the axial channel 104 in cartridge seat insert 56 with the horizontal slot 72 in the bolt 52, to provide smooth operation of the extractor 53 without binding. In one non-limiting embodiment, the right and left lateral sides 107, 108 of the cartridge seat insert 56 may generally be arcuately and convexly curved which mate with complementary configured concave surfaces in the cartridge seat insert mounting receptacle 93 of the bolt body.

The front vertical face of the seating portion 90 defines a vertical cartridge seating surface 106 (i.e. breech face) arranged to abuttingly engage the rear base end of the cartridge casing of cartridge C when the breech is closed (i.e. front of bolt 52 in battery with rear of barrel chamber 36. Seating surface 106 is recessed in the front end 95 of the front seating portion 90 such that the lateral sides 107 and 108 including right upper and lower wing segments 100, 102 protrude longitudinal forward beyond the seating surface. This arrangement defines a forwardly open cartridge cavity 301 which receives the rear or base end portion of cartridge C therein. The through passage 97 of the cartridge seat insert 56 penetrates the cartridge seating surface 106 to allow the narrowed front end of the firing pin 30 to be projected outwards beyond the seating surface to strike the central percussion cap at the base of the cartridge C via a cocked hammer 27 released by a trigger pull.

The cartridge seating surface 106 and cartridge cavity 302 are configured and dimensioned to match the base diameter of a particular type and caliber of cartridge C received into the front recess of the front seating portion 90. This ensures that the rear base end of the cartridge is properly supported during firing to prevent a cartridge casing rupture and provides positive extraction and ejection of the spend cartridge casing from receiver 21. The lateral sides 107, 108 of cartridge seat insert 56 define opposing concave and arcuately curved lateral support surfaces 301 arranged in cartridge cavity 302 which also act to keep the cartridge C centered and to support the rear end of the cartridge during both feeding the cartridge into the chamber 36 before firing the firearm and extracting the cartridge rearward from the chamber after firing. Support surfaces 301 face inwards towards the longitudinal axis LA and through passage 97.

In the present embodiment, the cartridge seat insert 56 may be removed and replaced by first dismounting the extractor 53. To then remove the cartridge seat insert, with reference to FIGS. 6-15, pull pins 60, 61 are first removed from the bolt 52 by pulling vertically upwards to disengage the pin from the slots 94 in the cartridge seat insert 56. The cartridge seat insert is then axially withdrawn forward and outwards from the frontal recess 92 in the front of the bolt 52 past the extractor. A new cartridge seat insert 56 is then axially reinserted rearward into the front recess 92 past the extractor after first axially aligning the channel 104 with extractor slot 72 in the bolt. The key 112 is inserted into keyway 111 in the bolt 52 until the vertical rear surface 115 of the front seating portion 90 abuts the mating front vertical surface 116 of the bolt 52 formed within the frontal recess 92 (see, e.g. FIG. 15). This firmly seats the cartridge seat insert fully against the bolt and vertically aligns the slots 94 in the cartridge seat insert 56 with pin holes 88, 89 in the top of the bolt 52. The pull pins 60, 61 are then reinserted through pin holes 88, 89 to engage the cartridge seat insert 56, thereby locking the new cartridge seat insert 56 in place. It will be appreciated that the latter basic mounting process steps noted above may be used to initially install a new cartridge seat insert on the bolt in the first place.

Blowback Operating System

According to one aspect, embodiments of the present firearm may include a "blowback" type action. Appendix A attached hereto and forming part of the written description describes and illustrates operation of the blowback action. It bears noting that the bolt 52 in this blowback action functions to form a closed, but not necessarily "locked" breech in a conventional sense. This is due to the fact that the bolt 52 does not have rotatable radial bolt lugs which interlock with lugs formed at the rear of the barrel chamber such as in locked breech type firearms. Instead, blowback type actions rely on the weight or mass of the bolt and return spring force to maintain a closed breech. Bolt 52 may therefore be both non-locking and non-rotating in one embodiment.

Referring now to FIGS. 5-15 and Appendix A, the blowback action includes dead blow weight assembly 59 comprising a dead blow weight 57 and dead blow top member 58 which cooperates with the dead blow weight to control cycling and timing of the action. Dead blow weight 57 is slideably received in upwardly open upper chamber 65 (i.e. rear portion 65*a*) of bolt 52 for forward and rearward movement therein with respect to the bolt. The dead blow weight provides the majority of "slide mass" of the dead blow weight assembly for the blowback type action. The dead blow top member 58 is slideably received in both the front and rear portions 65*a*, 65*b* of the bolt upper chamber 65, as further described herein.

Dead blow top member 58 may have a substantially flat plate-like body including a top 219, bottom 220, front end 216, rear end 217, and pair of opposing lateral sides 218 extending axially between the ends (see also FIGS. 21-27). Dead blow top member 58 have a substantially polygonal or rectilinear polygonal configuration. The body of the top member 58 may have a lateral width which is greater than the height or thickness of body. In one configuration, the dead blow top member has a length longer than a majority of the length of the bolt 52 and greater than rear section 65*a* of the upper chamber 65.

The dead blow top member 58 is slideably mounted in the bolt 52 above the dead blow weight 57 which is movably disposed in rear section 65*a* of the bolt upper chamber 65. Under recoil when the dead blow action is cycled, the dead blow top member 58 moves between a forward position and a rearward position relative to the bolt 52. To guide movement of the dead blow top member 58, the top member includes at least one outwardly and laterally projecting guide flange 304 disposed on each lateral side 218 of the dead blow top member body. In one embodiment, a pair of axially spaced apart guide flanges 304 may be formed on each lateral side of the dead blow top member. The guide flanges 304 are slideably received in mating longitudinally-extending guide channels 305 formed on the bolt (see, e.g. FIGS. 9 and 11). The opposing guide channels 305 are inwardly open and may extend for a majority of the length of the bolt body. A guide channel 305 is disposed in right and left lateral sides 73, 74 of bolt 52 and communicate with the front and rear sections 65*a*, 65*b* of the upper chamber 65. In one embodiment, the underside of the dead blow top member 58 may be vertically spaced apart from the top surface of the dead blow weight 57 providing a clearance therebetween such that the only direct and operable engagement between the dead blow top member and dead blow weight occurs at the downwardly extending engagement protrusions 213 at the rear end of the dead blow top member.

The dead blow weight 57 may have a generally block-like rectilinear body including a forward facing vertical front abutment surface 230, a rearward facing vertical rear abutment surface 231, pair of opposite lateral sides 306, top surface 307, and a bottom surface 308 which slides on the floor of the upper chamber rear section 65*a*. The four corners 310 of the dead blow weight 57 formed between the lateral sides and front/rear abutment surfaces may be convexly rounded in one embodiment (best shown in FIG. 9). These corners abuttingly engage corresponding concavely rounded corners 311 in rear section 65*a* of upper chamber 65 in the bolt 62 (see, e.g. FIG. 32) when the dead blow weight reciprocates forward/rearward in the cavity as the action is cycled. This combination of arcuately curved engagement surfaces reduces stress concentration factors in these corner regions to minimize cyclical stress fractures for repeated cycling of the bolt assembly. A longitudinally-extending bore 309 extends completely through the dead blow weight 57 and slideably receives the rear portion of firing pin 30 therethrough. The forward portion of the firing pin is received in axial bolt bore 64 in the bolt body.

When mounted in the bolt 52, the dead blow weight 57 is seated and positioned in open receptacle 210 of the bolt 52 formed by the deeper rear section 65*a* of the upper chamber 65. With additional reference to FIGS. 15 and 28-33, receptacle 210 defines a vertical front abutment wall 211 positioned to engage front abutment surface 230 of dead blow weight 57 and opposing rear abutment wall 212 positioned to engage rear abutment surface 231 of the weight. In one embodiment, the axial length of the receptacle 210 measured between front and rear walls 211, 212 is larger than the axial length 221 of the dead blow weight 57 to allow axial forward/rearward reciprocating movement of the weight within in the receptacle during recoil of the bolt and dead blow weight assembly (compare, e.g. Appendix A, FIGS. I and J). This forms a gap G between the dead blow weight 57 and receptacle front/rear abutment walls 211, 212, which may be present in front or behind the dead blow weight at various time when the bolt 52 is cycled, as further described herein. The upper chamber 65 has an axial length which may be longer than the length of the dead blow top member 58 to accommodate its reciprocating motion as well.

Dead blow weight 57 is biased and held forward in the bolt 52 by a return spring assembly which acts on the dead blow top member 58 that in turn acts on the dead blow weight. The return spring assembly generally includes axially oriented return spring 200 and spring rod 201. In one embodiment, spring 200 may be helical compression spring; however, other types of springs may be used. Spring rod 201 may be cylindrical and axially elongated in the direction of the longitudinal axis LA. Rod 201 has a front end 222 which is slideably received through an axially oriented captive mounting bore 203 formed in dead blow member 58 proximate to its front end 216 (see, e.g. FIGS. 21-22). In one embodiment, bore 203 is formed on an upwardly extending rod mounting protrusion 202 disposed proximate to front end 216. Accordingly, spring 200 also indirectly biases bolt 52 forward because the spring force is applied through the dead blow weight assembly to the bolt, as further described herein. It bears noting that other locations of axial bore 203 and mounting protrusion 202, however, are possible.

Figure 5:
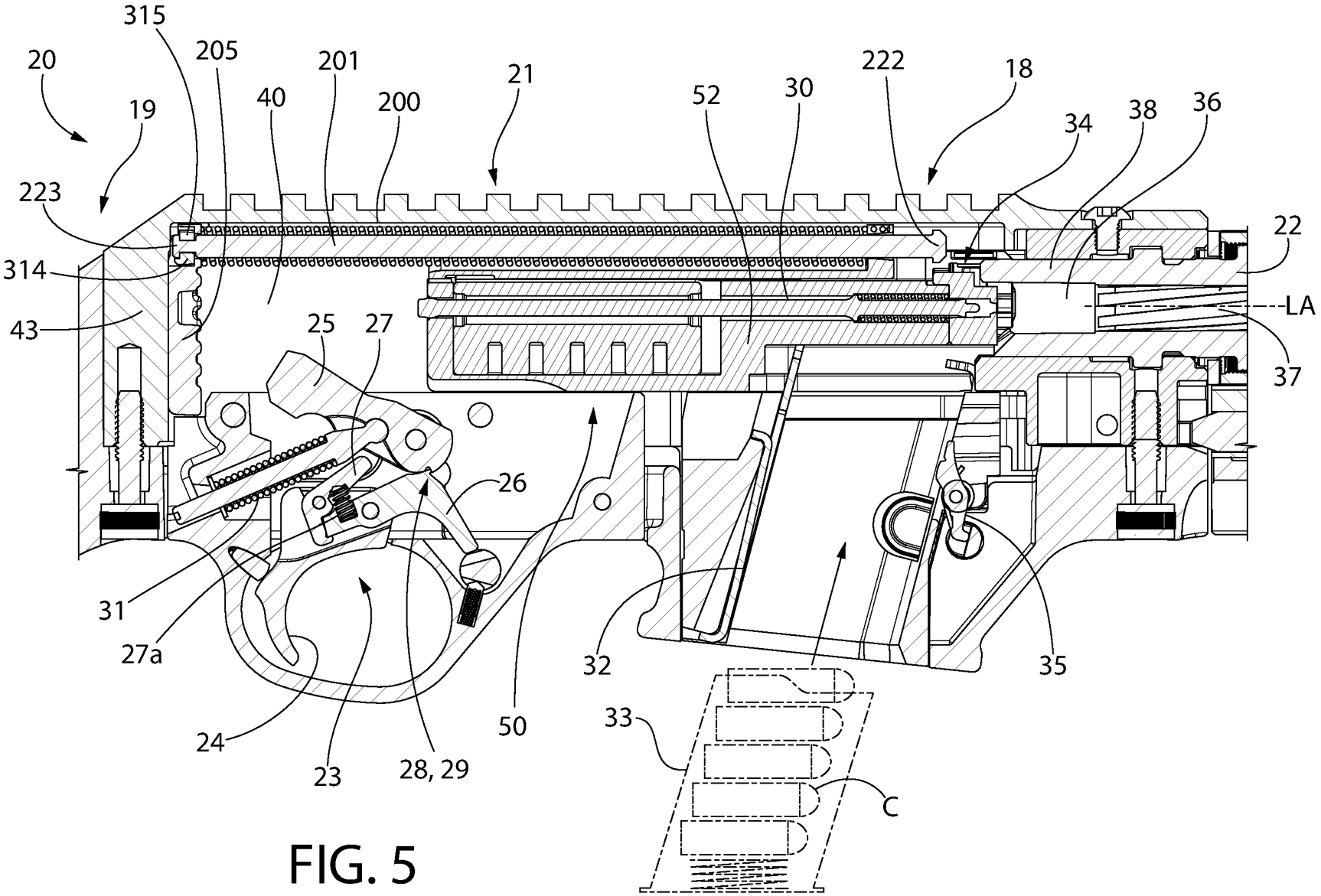
FIG. 5 is an enlarged view of the breech area of the firearm taken from FIG. 4.

The rear end 223 of the spring rod 201 may be fixedly attached to rear end wall 43 of the receiver 21 inside cavity 40, or alternatively to buffer pad 205 disposed on the end wall 43 inside receiver cavity 40 as illustrated (see, e.g. FIGS. 5 and 9). Buffer pad 205 may include an axially oriented mounting hole 314, which in one embodiment may be formed in an upright protrusion of the pad as shown, that receives the rear end 223 of spring rod 201 (see, e.g. FIG. 9). Any suitable type of removable or permanent mechanical attachment feature 315 may be used to secure the spring rod 201 to the buffer pad 205, for example without limitation clips, fasteners, welding, adhesives, friction fit, interference fit, interlock fits, etc.

The rear end of spring 200 acts on the rear of the receiver 21 or alternatively buffer pad 205. The front end of spring 200 acts on the rod mounting protrusion 202 of the dead blow top member 58. Advantageously, the location of the mounting protrusion 202 on the front of the dead blow top member 58 maximizes the length of spring 200 that can be used, which in turn maximizes the spring force that can be delivered to maintain a closed breech via interaction between the dead blow weight assembly 59 and bolt 52. Return spring 200 has a horizontal line of action (i.e. parallel to longitudinal axis LA) imparted to the upright mounting protrusion 202 of the dead blow weight 57 which is vertically offset from and parallel to the longitudinal axis LA of the firearm (see, e.g. FIG. 5).

The front end 222 of spring rod 201 may be diametrically enlarged relative to portions of the rod rearward from the front end including the rear end of the rod. This prevents the dead blow top member 58 from sliding off the front of rod when the bolt cycles rearward and forward in the receiver 21 after firing the firearm or manually cycling the action. The enlarged front end 222 thus may have a diameter larger than the axial bore 203 in the mounting protrusion 202 of the dead blow top member 58. In one configuration, a longitudinally-extending concavity 204 may be formed in the top surface of dead blow top member 58 to partially receive the spring 200 and rod 201 therein. Concavity 204 extends axially for a majority of the length of dead blow top member 58 from mounting protrusion 202 rearwards to and penetrating rear end 217 of the top member in one embodiment. This advantageously contributes to the compactness of the design.

According to one aspect, the dead blow top member 58 is configured and operable to selectively engage dead blow weight 57 for moving the weight in upper chamber 65 of the bolt 52 when the bolt is cycled forward/rearward in recoil after discharging the firearm. Referring to FIGS. 21-27 and 34 and also Appendix A, dead blow top member 58 includes at least one weight engagement protrusion 213 arranged to engage dead blow weight 57. In one non-limiting embodiment, a pair of laterally spaced apart engagement protrusions 213 may be provided. Protrusions 213 extends downwardly from the bottom surface 220 of the dead blow top member. In one embodiment, the engagement protrusions 213 are preferably disposed at the rear end 217 of the dead blow top member 58, and more preferably at the rear corners of the rear end to maximize the lateral spread of the protrusions. This positions the engagement protrusions 213 rearward of dead blow weight 57 to contact the two rear corner 310 regions of the dead blow weight.

Operation of the blowback operating system and bolt assembly will now be briefly summarized. The operation of the blowback system and reciprocating action of the bolt 52 and dead blow weight 57 is shown sequentially in FIGS. 35-49 and described below. Note that directional arrows show movement/direction of the firing components.

Referring to FIGS. 35-49, when the bolt is in the forward ready-to-fire position with a closed breech (FIG. 35), the return spring 200 urges the dead blow weight assembly 59 forward with respect to the bolt 52 to maintain breakable engagement of the dead blow weight 57 with the front abutment wall 211 in receptacle 210 of bolt 52. The bolt head (cartridge seat insert 56) engages and holds the cartridge C in the chamber 36. The spring-biased hammer 25 is cocked rearward and ready for release.

Figure 36:
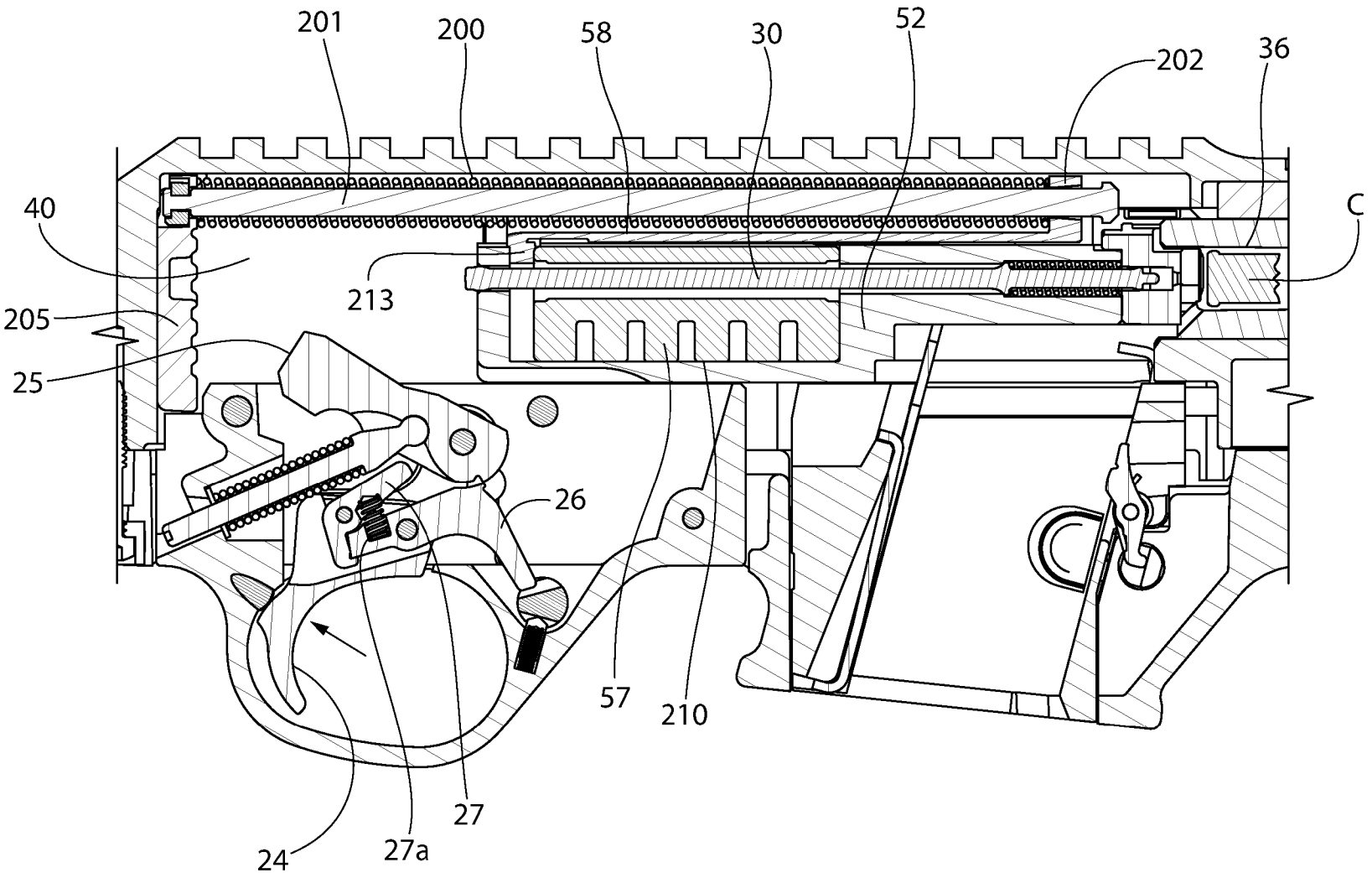
FIG. 36 is a second sequential view thereof.
Figure 37:
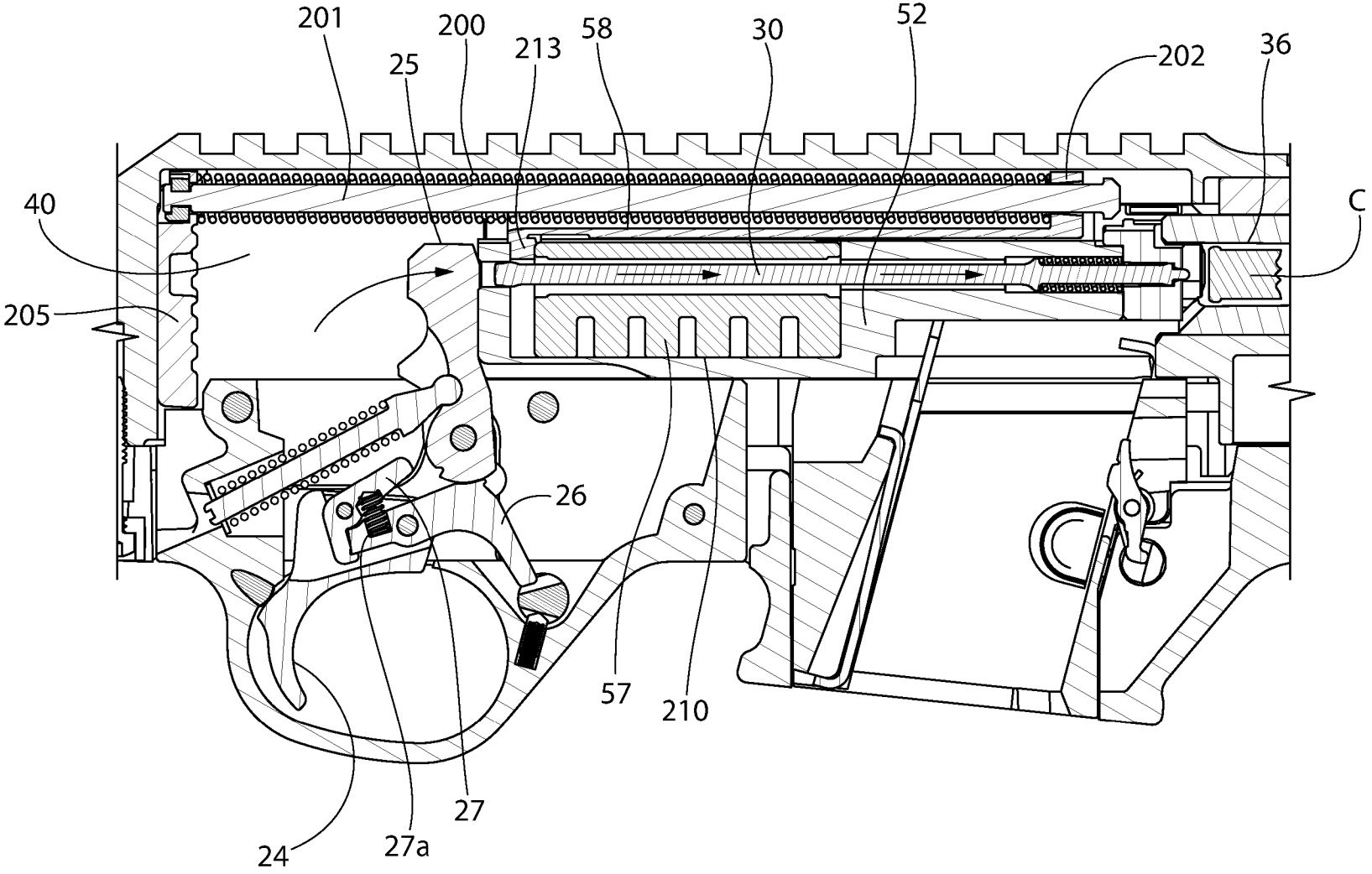
FIG. 37 is a third sequential view thereof.

In FIG. 36, the trigger 24 is pulled to discharge the firearm. Pulling the trigger lifts the disconnector 27, rotating the sear 26 downwards (clockwise). The sear releases hammer 25 which rotates forward (clockwise). The hammer drops and impacts the firing pin 30 (FIG. 37) driving it linearly forward to strike the chambered cartridge C and ignite the primer.

Figure 38:
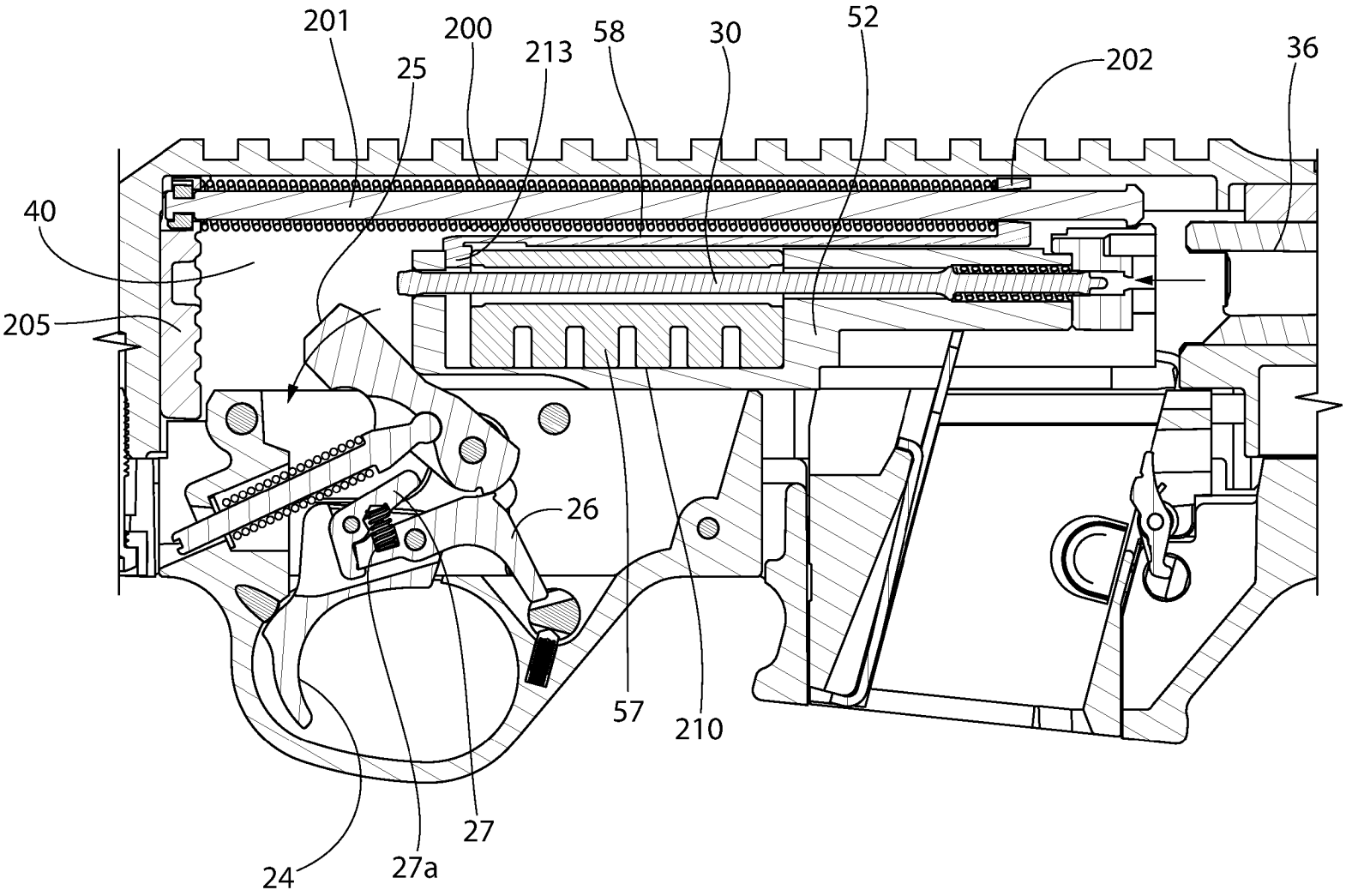
FIG. 38 is a fourth sequential view thereof.
Figure 39:
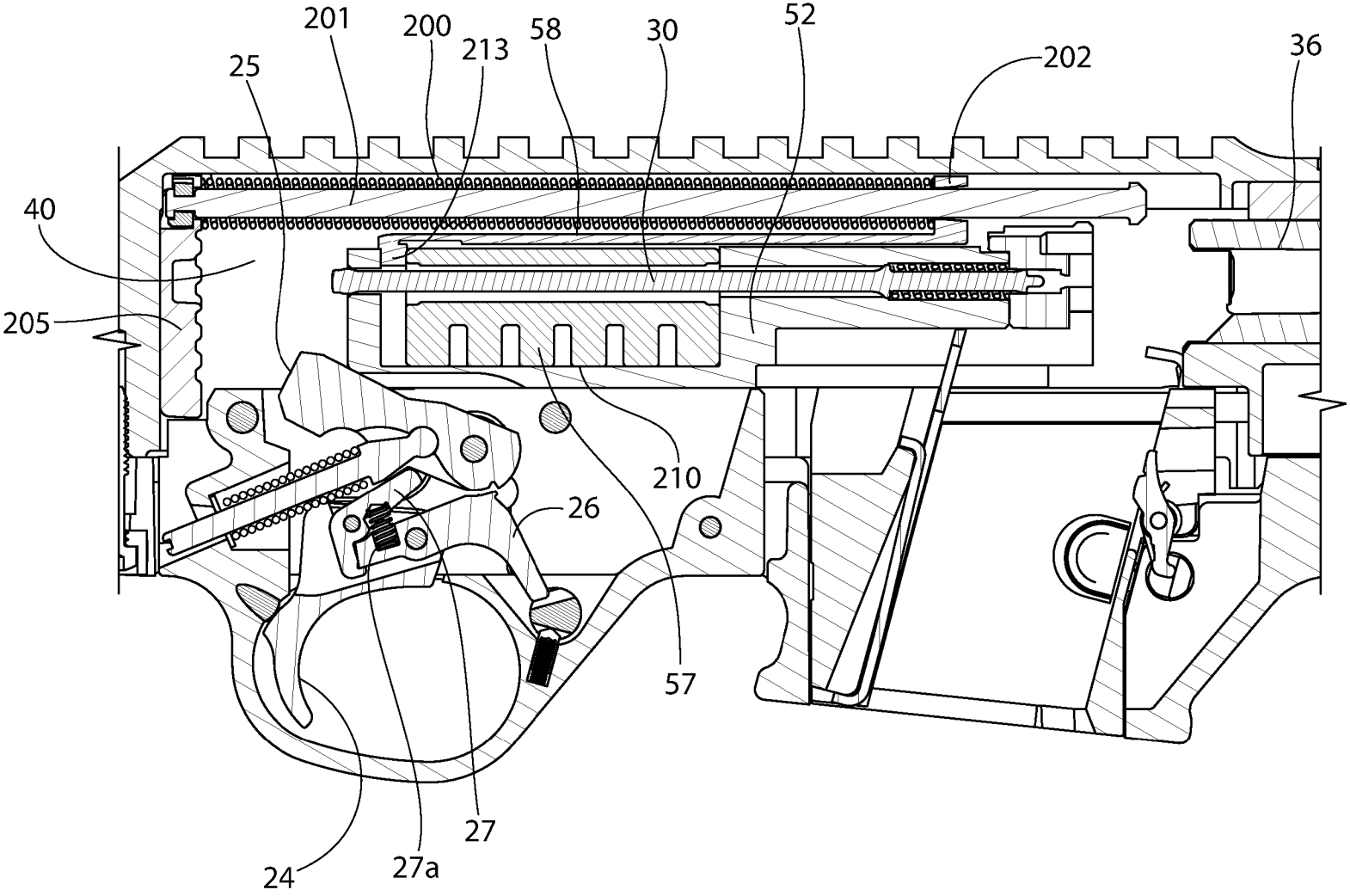
FIG. 39 is a fifth sequential view thereof.
Figure 40:
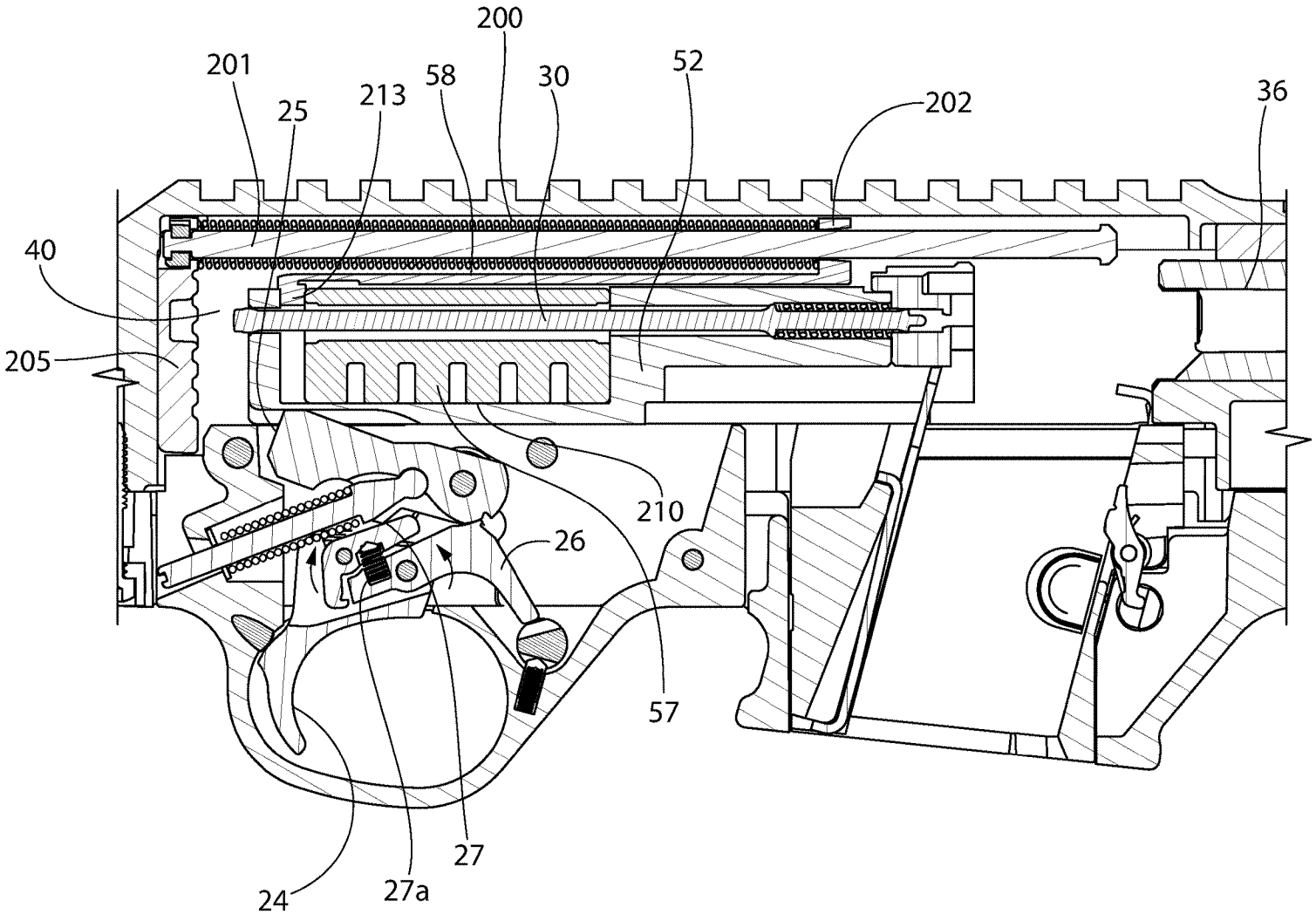
FIG. 40 is a sixth sequential view thereof.
Figure 41:
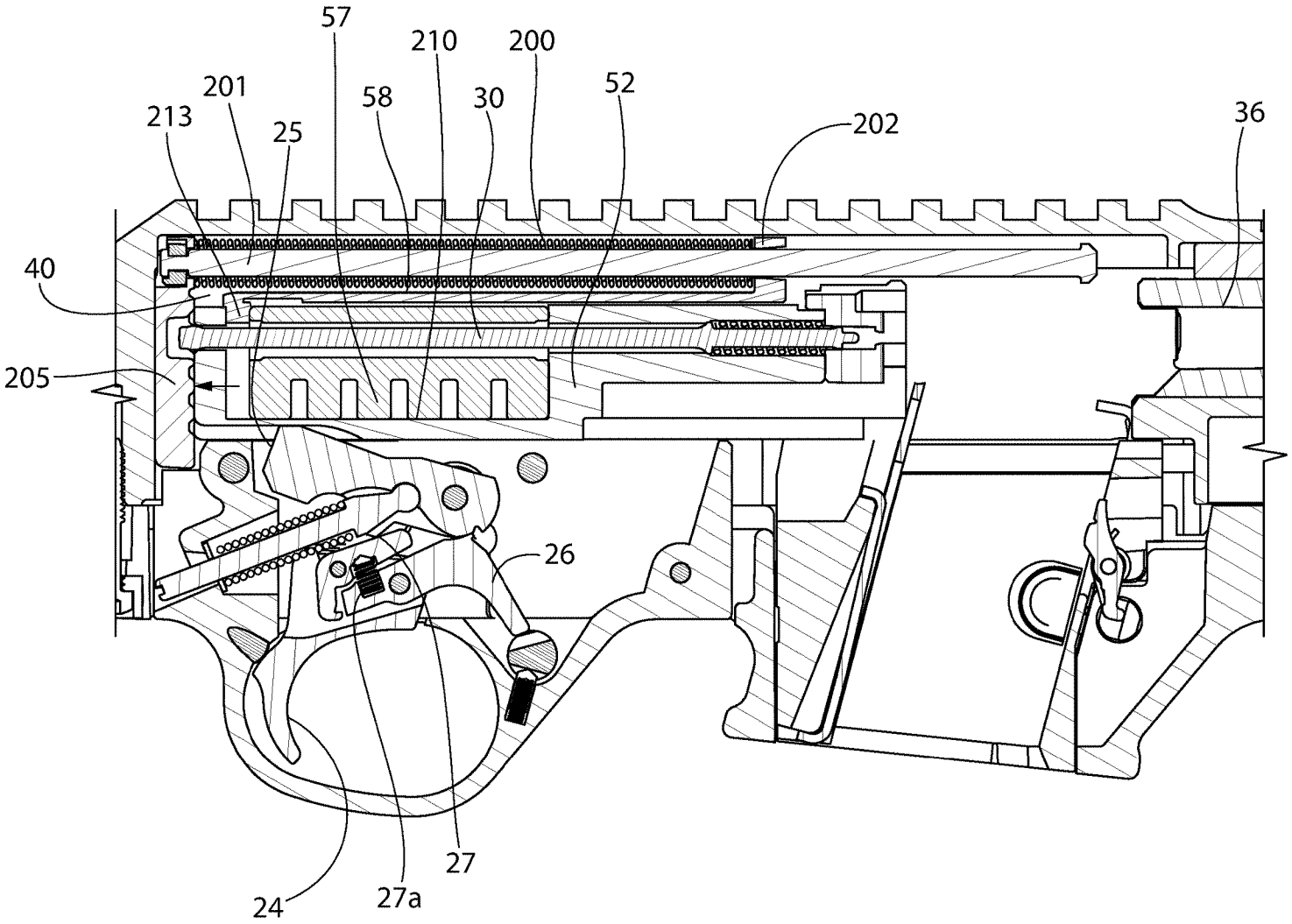
FIG. 41 is a seventh sequential view thereof.
Figure 42:
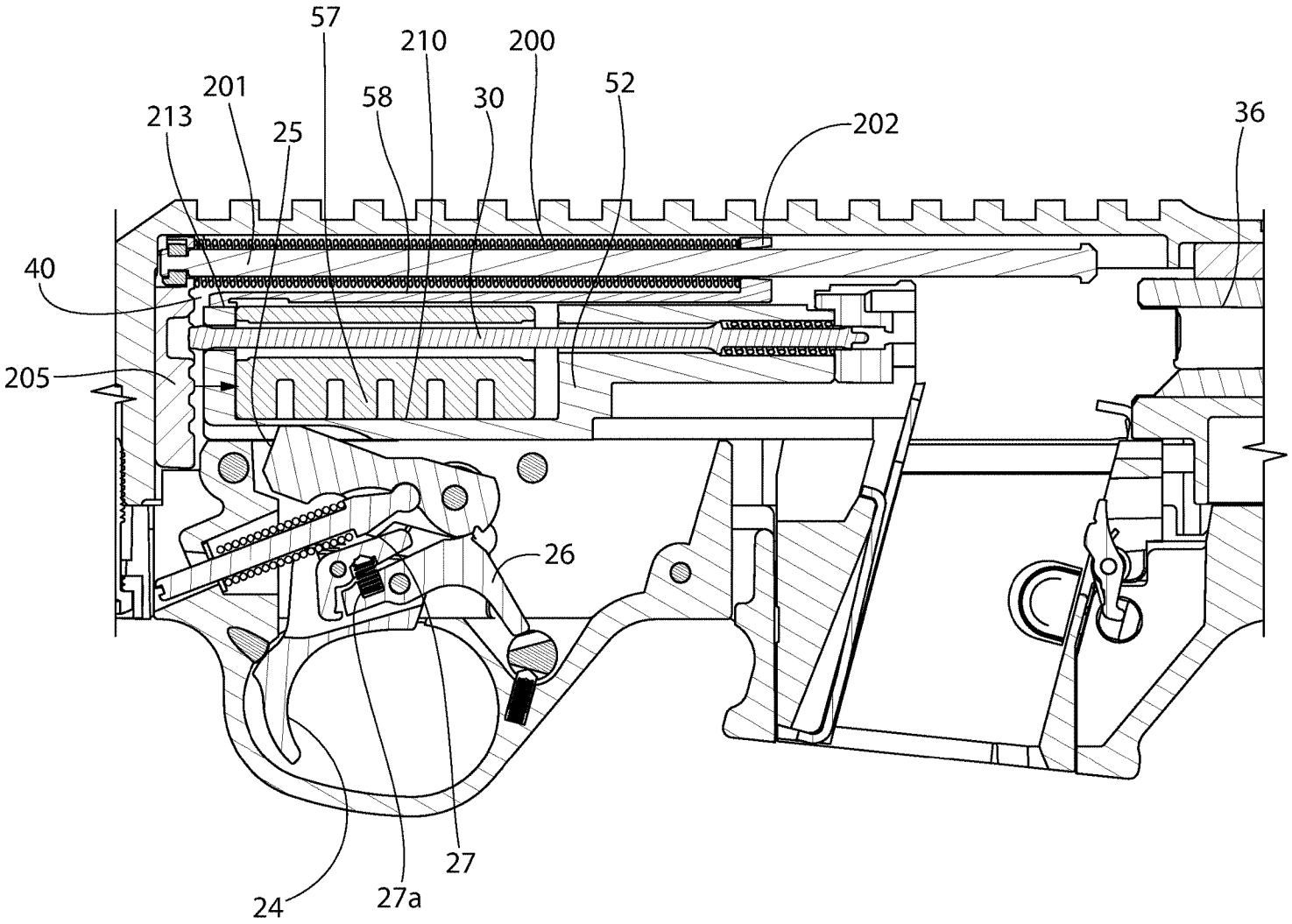
FIG. 42 is a eighth sequential view thereof.

After firing the firearm via actuating the trigger, the ignited cartridge pushes rearward on the bolt head, pushing the bolt 52 rearward. The bolt 52 carries the dead blow weight 57 linearly and axially rearward with it via the mutually engaged front abutment wall 211 and abutment surface 230 of the dead blow weight (FIG. 38). The dead blow weight 57 in turn carries the dead blow top member 58 linearly reward with it via engagement between the rear engagement protrusions 213 on the top member with the rear abutment surface 231 of the dead blow weight. The rod mounting protrusion 202 on the dead blow top member 58 axially slides rearward along spring rod 201 (which remains stationary when the bolt is cycled rearward/forward) and compresses return spring 200. During the process, the rearward travelling bolt 52 contacts and pushes/rotates the hammer 25 rearward and downward (counter-clockwise). The rotating hammer 25 makes first contact with the forward portion of the disconnector 27 to rotate it downwards (clockwise) as shown in FIG. 39. The rotating disconnector releases the sear 26. The sear rotates upwards due to the disconnector spring 27*a* acting downwards on the rear end of the sear (FIG. 40). During the process, the bolt assembly 50 and dead blow weight 59 continues traveling rearward in unison.

When the bolt 52 reaches its rearward-most position in the receiver 21 and abuttingly strikes the buffer plate 205 (FIG. 41), the bolt rebounds forward off the buffer plate and the dead blow weight 57 slides and shifts axially rearward in receptacle 210 of the bolt 52 from its initial forward position to a rearward position. This breaks engagement between the front abutment surface 230 of the dead blow weight 57 and the front abutment wall 211 of the bolt 52 inside the receptacle. The rearward traveling rear abutment surface 231 of the weight abuttingly meets and contacts the rear abutment wall 212 of the receptacle (FIG. 42) to temporarily hold the bolt assembly rearward momentarily against the forward biasing effect of spring 200, thereby allowing time for a fresh cartridge to be uploaded into the action from the magazine before the bolt starts moving forward again. The forward motion of the bolt 52 is thus very briefly stopped or arrested.

Figure 43:
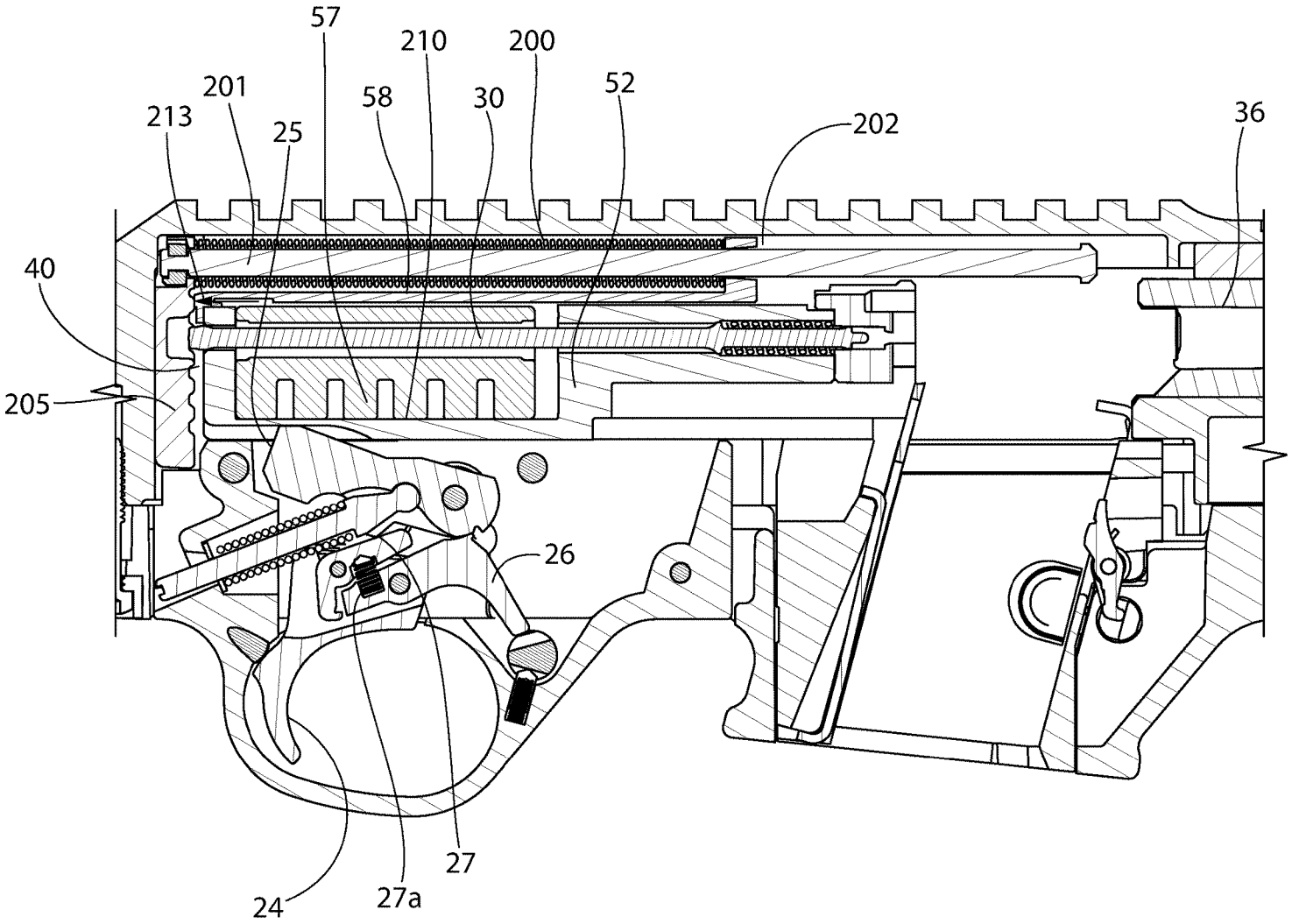
FIG. 43 is a ninth sequential view thereof.
Figure 44:
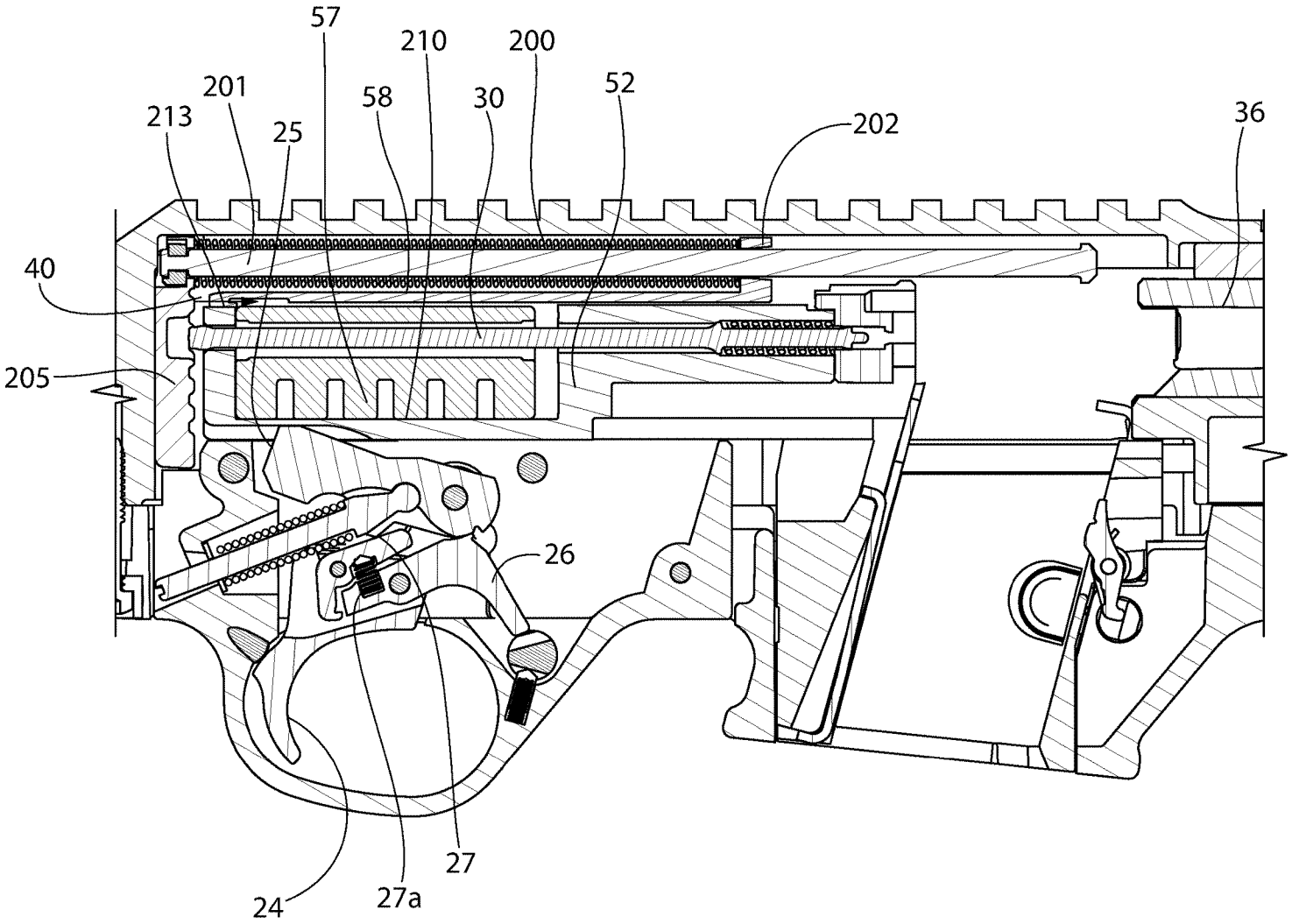
FIG. 44 is a tenth sequential view thereof.
Figure 45:
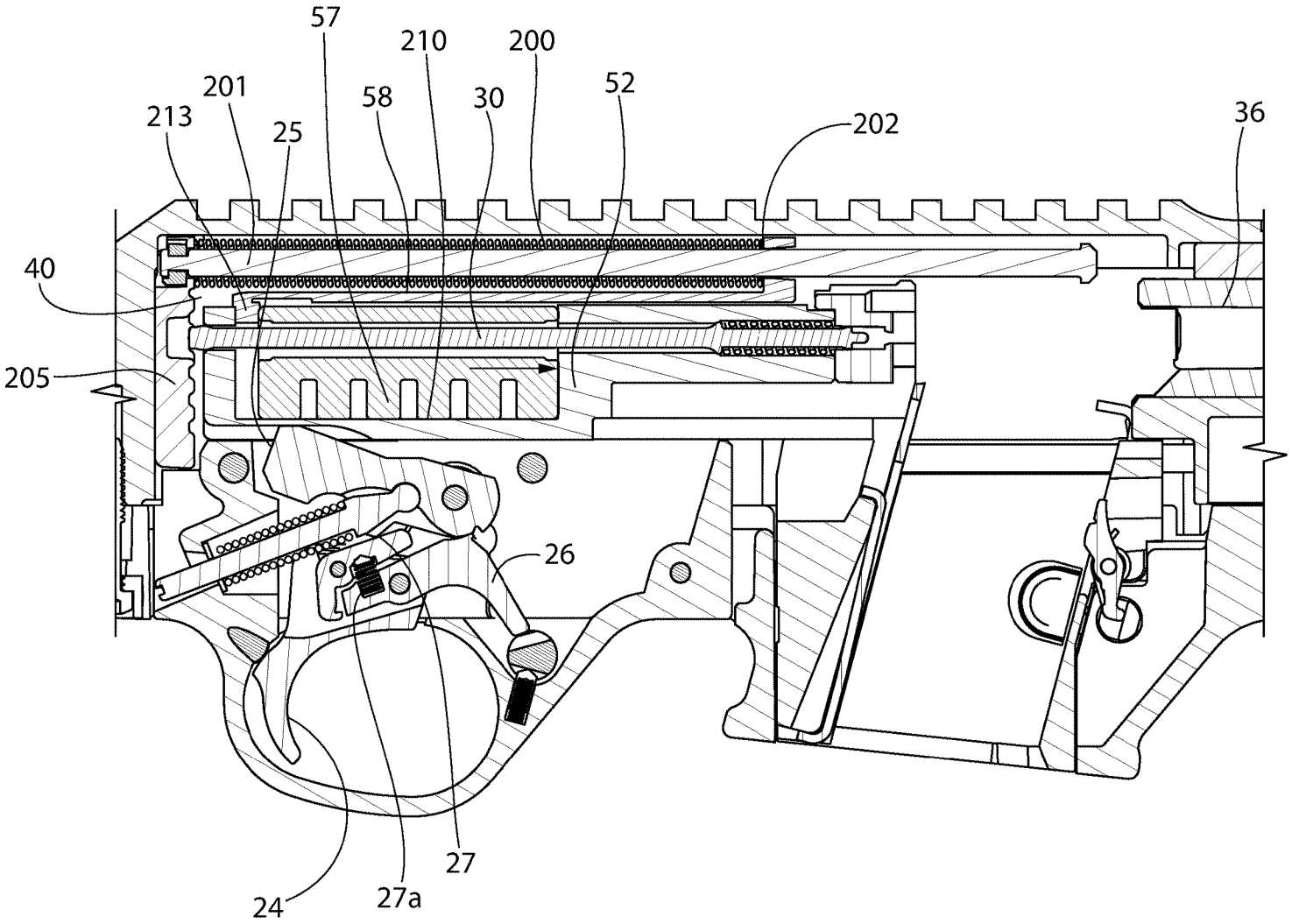
FIG. 45 is a eleventh sequential view thereof.
Figure 46:
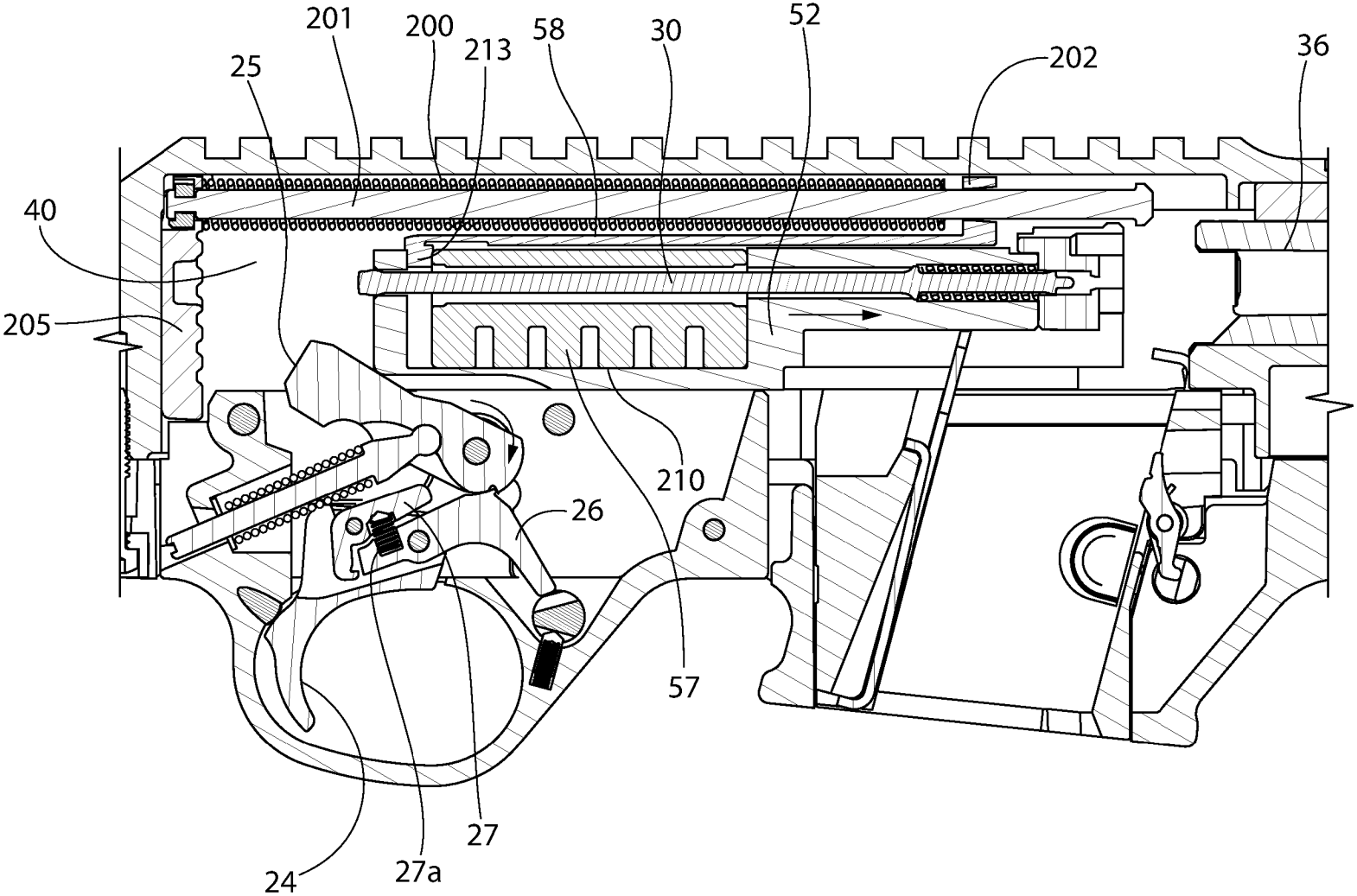
FIG. 46 is a twelfth sequential view thereof.
Figure 47:
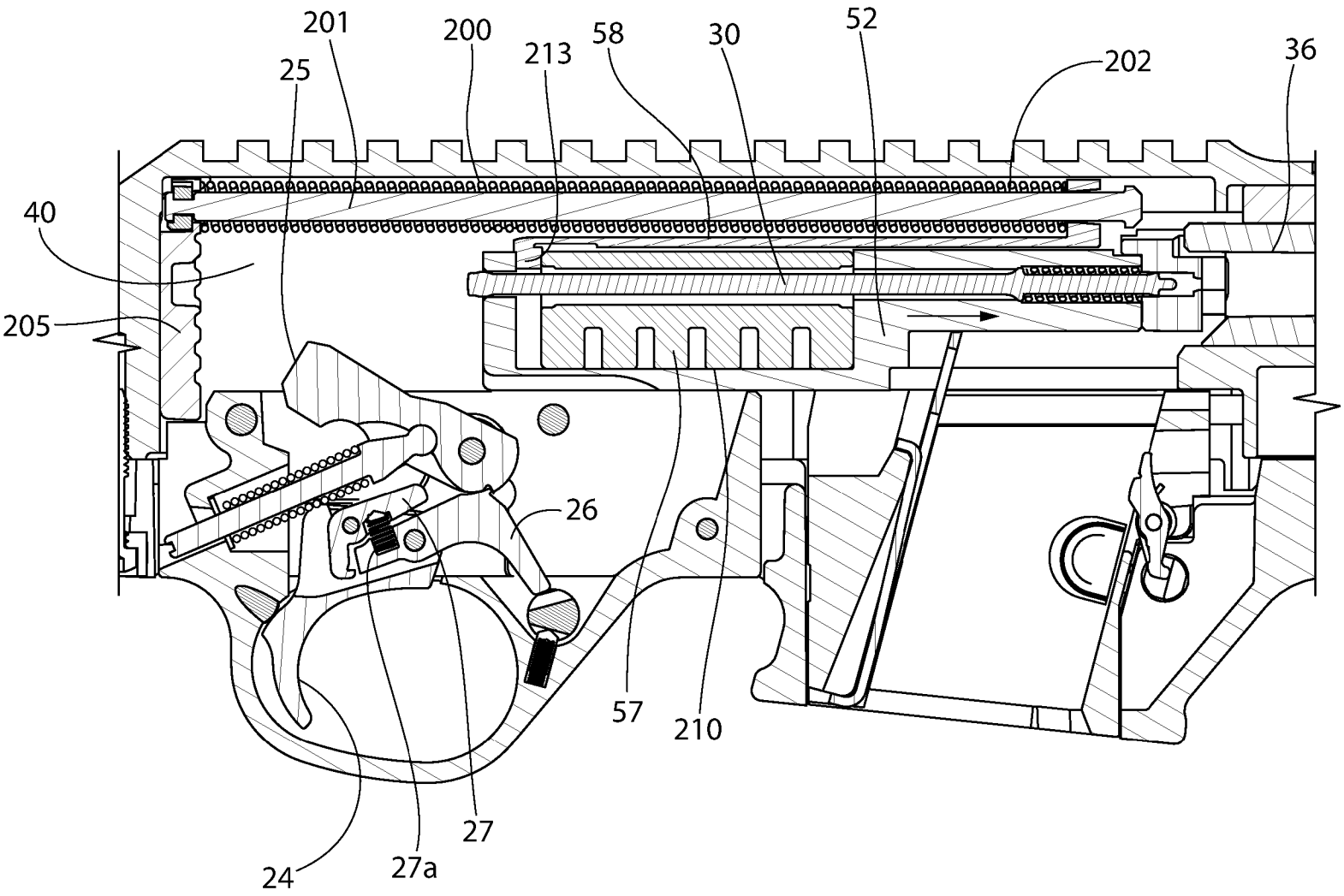
FIG. 47 is a thirteenth sequential view thereof.

The dead blow top member 58 continues to travel rearward independently of the bolt 52 and dead blow weight 57. Engagement between downwardly depending protrusions 213 and the rear of the dead blow weight 57 is broken. The dead blow top member then makes contact with the buffer plate 205 (FIG. 43). It bears noting that the dead blow weight 57 itself does not contact the buffer plate 205. The dead blow top member 58 rebounds forward and re-engages the dead blow weight 57 via downwardly depending protrusions 213 (FIG. 44). The dead blow weight and dead blow top member travel forward together in mutual engagement. This returns the dead blow weight 57 forward in receptacle 210 and re-engages front abutment surface 230 of the dead blow weight 57 with the front abutment wall 211 of the bolt 52 inside the receptacle (FIG. 45). The engaged assembly of the dead blow weight, dead blow top member, and bolt move axially forward in unison under the forward biasing force of return spring 200 (FIG. 46). The dead blow weight assembly 59, dead blow top member 58, and bolt 52 continue travelling forward until the breech is re-closed (FIG. 47).

Figure 48:
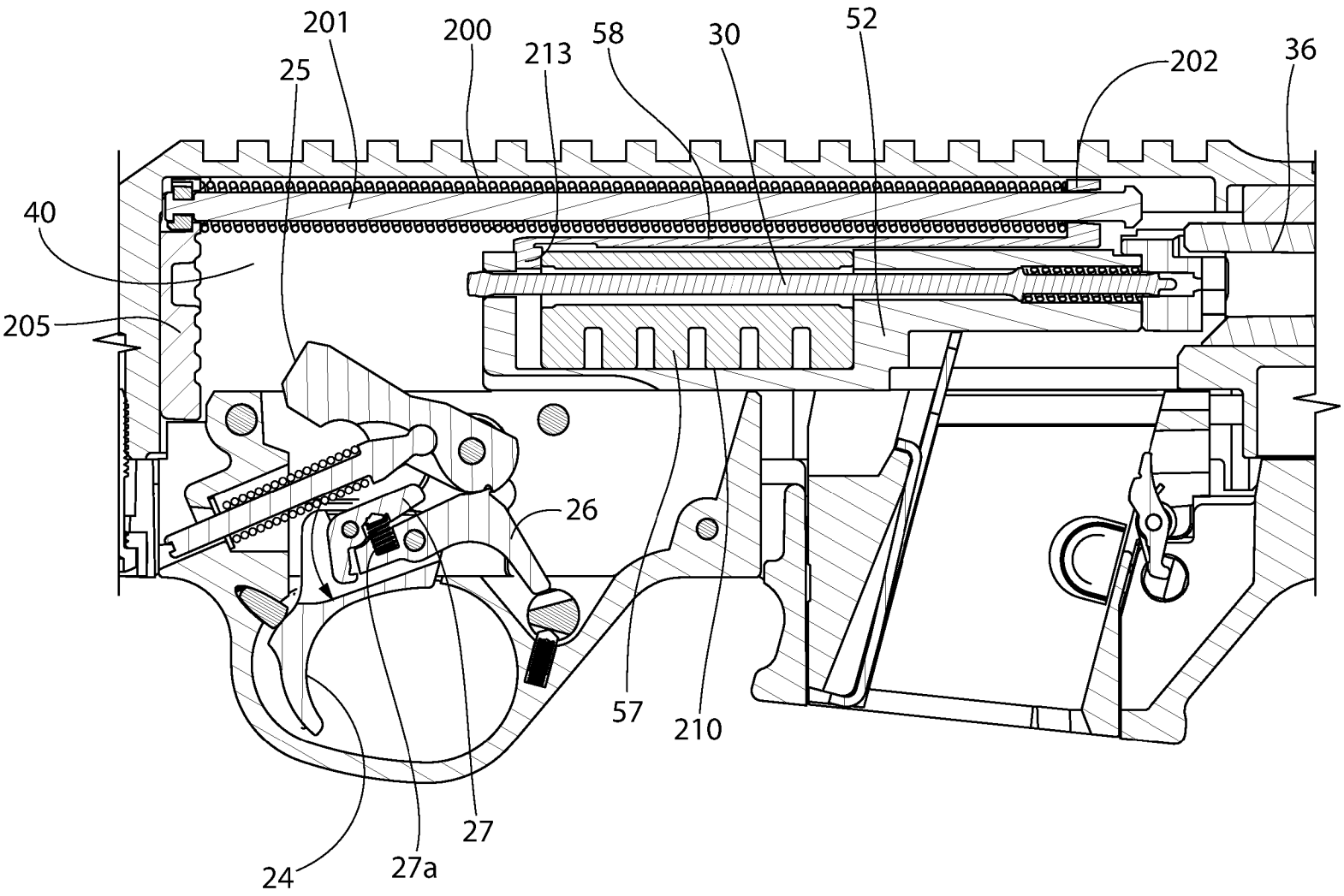
FIG. 48 is a fourteenth sequential view thereof.
Figure 49:
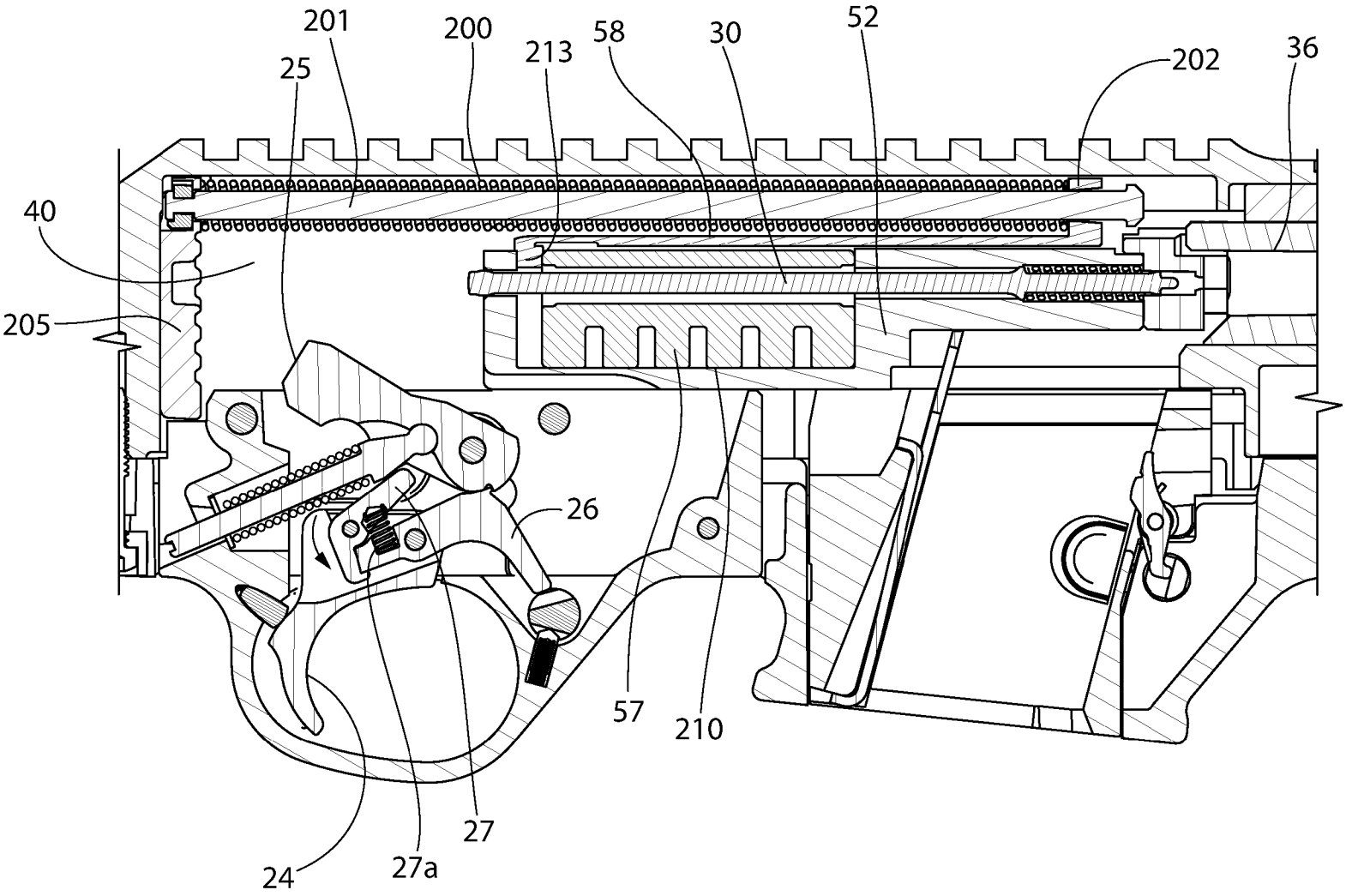
FIG. 49 is a fifteenth sequential view thereof.

As the breech closes, a fresh cartridge is uploaded into the action and chambered. In the process, the underside of the bolt 52 disengages the hammer 25, which is held rearward and cocked by sear 26 for the next shot. The bolt 52 is in battery with chamber 36 of the barrel again. The trigger 24 is released and starts to rotate forward (FIG. 48). The disconnector 27 lowers with the trigger. As the disconnector lowers, the disconnector spring 27*a* applies a rotational force, trying to rotate the disconnector. Once the disconnector 27 lowers far enough, it rotates and "hooks" onto the sear 26 (FIG. 49). The trigger can now be pulled again and the whole forgoing cycle repeats.

By using essentially a two piece bolt mechanism, a bolt 52 and a dead blow weight assembly 59 compressed against the bolt by spring 200 but movable relative to the bolt, the blowback mechanism acts as a one piece bolt for absorption of the cartridge energy, but delivers two smaller impacts of less magnitude to the rear of the receiver after discharging the firearm than a traditional one-piece bolt. The resultant effect of this advantageously is a lighter recoil force imparted to the shooter and a delayed rebound of the bolt. Delaying the bolt 52 from rebounding back forward into battery with the barrel allows a split second more time for a fresh cartridge in the magazine to pop up into a position forward of the bolt and be ready for the bolt to strip it away from the magazine as the bolt advances into battery (closed breech). The reduction in peak recoil force does not mean that there is a reduction in overall actual recoil energy produced by the firearm. Rather, the recoil sensed or felt by the shooter ("felt recoil") is advantageously lessened.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A blowback type firearm with bolt assembly, the firearm comprising:

a longitudinal axis;

a receiver defining a longitudinally-extending cavity;

a barrel supported by the receiver;

a bolt slideably mounted in the receiver for reciprocating movement between a forward closed breech position in battery with the barrel and a rearward open breech position;

a dead blow weight assembly slideably mounted to the bolt, the dead blow weight assembly moveable relative to the bolt between a forward position and rearward position; and a return spring acting on the dead blow weight assembly, the return spring biasing the dead blow weight assembly towards the forward position, the dead blow weight assembly in turn acting on and biasing the bolt towards the closed breech position;

wherein the bolt and dead blow weight assembly remains parallel with the longitudinal axis when the bolt is in the forward closed breech and rearward open breech positions.

2. The firearm according to claim 1, wherein the dead blow weight assembly comprises:

a dead blow weight slideably mounted to bolt; and an axially elongated dead blow top member slideably mounted on top of the bolt and operably engageable with the dead blow weight, the dead blow top member axially movable forward and rearward relative to both the dead blow weight and bolt.

3. The firearm according to claim 2, wherein the dead blow top member is further slideably mounted on top of the dead blow weight.

4. The firearm according to claim 3, wherein the dead blow weight is slideably disposed in an upwardly open chamber of the bolt.

5. The firearm according to claim 2, wherein the dead blow weight engages a rear facing surface of the bolt when the dead blow weight assembly is in a forward position, and the dead blow weight is axially spaced apart from the rear facing surface of the bolt when the dead blow weight assembly is in the rearward position.

6. A blowback type firearm with bolt assembly, the firearm comprising:

a longitudinal axis;

a receiver defining a longitudinally-extending cavity;

a barrel supported by the receiver;

a bolt slideably mounted in the receiver for reciprocating movement between a forward closed breech position in battery with the barrel and a rearward open breech position;

a dead blow weight assembly slideably mounted to the bolt, the dead blow weight assembly moveable relative to the bolt between a forward position and rearward position; and a return spring acting on the dead blow weight assembly, the return spring biasing the dead blow weight assembly towards the forward position, the dead blow weight assembly in turn acting on and biasing the bolt towards the closed breech position;

the dead blow weight assembly comprising:

a dead blow weight slideably mounted to bolt; and an axially elongated dead blow top member slideably mounted on top of the bolt and operably engageable with the dead blow weight, the dead blow top member axially movable forward and rearward relative to both the dead blow weight and bolt wherein the dead blow top member comprises at least one downwardly extending engagement protrusion selectively engageable with the dead blow weight.

7. The firearm according to claim 1, wherein the dead blow top member comprises a laterally spaced apart pair of engagement protrusions.

8. The firearm according to claim 1, wherein the dead blow top member is axially movable between a first forward position in which the at least one downwardly extending engagement protrusion is engaged with the dead blow weight, and a second rearward position in which the at least one downwardly extending protrusion is disengaged from the dead blow weight.

9. The firearm according to claim 2, wherein the return spring acts on the dead blow top member which in turn biases the dead blow weight assembly towards the forward position.

10. The firearm according to claim 9, wherein the return spring acts on an upwardly projecting mounting protrusion disposed on the dead blow top member which biases the dead blow weight assembly towards the forward position.

11. The firearm according to claim 10, wherein the return spring is mounted on an axially elongated spring rod received through an aperture of the upwardly projecting mounting protrusion on the dead blow top member, the mounting protrusion being slideable along the spring rod when the bolt is moved between the open and closed breech positions.

12. The firearm according to claim 1, further comprising an axially elongated firing pin extending through the dead blow weight assembly and bolt for striking a chambered cartridge.

13. The firearm according to claim 12, wherein the firing pin has a rear end projecting rearwards from mating apertures in the dead blow weight and bolt, and a front end configured for striking a cartridge chambered in the barrel.

14. The firearm according to claim 2, further comprising a vertically buffer plate mounted in a rear of the cavity in the receiver, a rear end of the dead blow top member selectively engageable with the buffer plate when the dead blow top member is in a rearward position on the bolt.

15. The firearm according to claim 14, wherein a rear end of the dead blow top member is disposed inside an upwardly open chamber of the bolt when the dead blow top member is in a forward position, and the rear end is disposed outside the chamber to strike the buffer plate when dead blow top member is in the rearward position.

16. The firearm according to claim 2, wherein the dead blow top member is slideably mounted to the bolt by a pair of guide flanges received in mating longitudinally-extending guide channels formed on the bolt.

17. The firearm according to claim 1, wherein the bolt comprises a removable bolt head formed by a cartridge seat detachably mounted to a bolt body by a pinned connection.

18. A blowback type firearm with bolt assembly, the firearm comprising:

a longitudinal axis;

a receiver housing a trigger-actuated firing mechanism and defining an axially elongated cavity;

a barrel supported by the receiver;

a bolt slideably mounted in the cavity of the receiver for reciprocating movement between a forward closed breech position in battery with the barrel and a rear open breech position;

a dead blow weight assembly slideably mounted to the bolt, the dead blow weight assembly moveable relative to the bolt between a forward position and rearward position;

the dead blow weight assembly comprising:

a dead blow weight slideably mounted in a chamber of the bolt and movable forward and rearwards therein; and an axially elongated dead blow top member slideably positioned on top of the bolt and the dead blow weight, the dead blow top member axially movable forward and rearward relative to both the dead blow weight and bolt;

a return spring acting on the dead blow weight assembly, the return spring biasing the dead blow weight assembly towards the forward position, the dead blow weight assembly in turn acting on and biasing the bolt towards the closed breech position;

wherein the dead blow top member is engageable with the dead blow weight.

19. The firearm according to claim 18, wherein the dead blow top member comprises a downwardly depending protrusion which is selectively engageable with a rear end of the dead blow weight.

20. The firearm according to claim 19, wherein the return spring acts on an upwardly projecting mounting protrusion disposed on the dead blow top member which biases the dead blow weight forward to in turn bias the dead blow weight assembly towards the forward position.

21. The firearm according to claim 18, wherein the dead blow weight engages a rear facing surface in the chamber of the bolt when the dead blow weight assembly is in the forward position, and the dead blow weight engages a front facing surface in the chamber of the bolt when the dead blow weight assembly is in the rearward position.

22. A blowback type firearm with bolt assembly, the firearm comprising:

a longitudinal axis;

a receiver housing a trigger-actuated firing mechanism and defining an axially elongated cavity;

a barrel supported by the receiver;

a bolt slideably mounted in the cavity of the receiver for reciprocating movement between a forward closed breech position in battery with the barrel and a rear open breech position;

a dead blow weight assembly slideably mounted to the bolt, the dead blow weight assembly moveable relative to the bolt between a forward position and rearward position;

the dead blow weight assembly comprising:

a dead blow weight slideably mounted in a chamber of the bolt and movable forward and rearwards therein; and an axially elongated dead blow top member slideably positioned on top of the bolt and the dead blow weight, the dead blow top member axially movable forward and rearward relative to both the dead blow weight and bolt;

a return spring acting on the dead blow weight assembly, the return spring biasing the dead blow weight assembly towards the forward position, the dead blow weight assembly in turn acting on and biasing the bolt towards the closed breech position;

wherein the dead blow top member is slideably mounted to the bolt by a pair of guide flanges received in mating longitudinally-extending guide channels formed on the bolt.

23. The firearm according to claim 18, wherein the chamber in the bolt is upwardly open and covered by the dead blow top member.

24. A blowback type firearm with bolt assembly, the firearm comprising:

a longitudinal axis a receiver defining an axially elongated cavity;

a barrel supported by the receiver;

a non-rotatable bolt slideably mounted in the cavity of the receiver for reciprocating movement between a forward closed breech position in battery with the barrel and a rear open breech position;

a dead blow weight slideably disposed in an upwardly open chamber of the bolt, the dead blow weight moveable relative to the bolt between a forward position engaging a front surface in the chamber when the bolt is in the closed breech position, and a rearward position engaging a rear surface in the chamber when the bolt is in the open breech position;

an axially elongated dead blow top member slideably positioned on top of the bolt and selectively engageable with the dead blow weight, the dead blow top member axially movable forward and rearward relative to both the dead blow weight and bolt;

a return spring acting on the dead blow top member, the return spring biasing the dead blow top member forwards which in turn biases the dead blow weight towards the forward position;

the dead blow weight in turn biasing the bolt towards the closed breech position.

25. The firearm according to claim 24, wherein the dead blow top member comprises at least one downwardly projecting engagement protrusion selectively engageable with the dead blow weight, and an upwardly projecting mounting protrusion which is acted on by the return spring to bias the dead blow top member forward.

26. The firearm according to claim 24, wherein the dead blow top member has a plate-like body which is axially longer than the chamber of the bolt.

27. The firearm according to claim 24, wherein the chamber of the bolt comprises a vertically deeper rear section in which the dead blow weight is disposed and a shallower front section, the dead blow top member extending axially over both the front and rear sections of the chamber.

28. The firearm according to claim 24, wherein the dead blow top member has a longer axial length than the dead blow weight.

* * * * *